US009956456B2

(12) United States Patent
Kamino et al.

(10) Patent No.: US 9,956,456 B2
(45) Date of Patent: May 1, 2018

(54) GOLF BALL

(71) Applicant: DUNLOP SPORTS CO. LTD., Kobe-shi, Hyogo (JP)

(72) Inventors: Kazuya Kamino, Kobe (JP); Kosuke Tachibana, Kobe (JP)

(73) Assignee: DUNLOP SPORTS CO. LTD., Kobe-shi, Hyogo (JP)

( * ) Notice: Subject to any disclaimer, the term of this patent is extended or adjusted under 35 U.S.C. 154(b) by 18 days.

(21) Appl. No.: 15/138,484

(22) Filed: Apr. 26, 2016

(65) Prior Publication Data

US 2016/0310799 A1 Oct. 27, 2016

(30) Foreign Application Priority Data

Apr. 27, 2015 (JP) ..... 2015-090790

(51) Int. Cl.
*A63B 37/02* (2006.01)
*A63B 37/00* (2006.01)

(52) U.S. Cl.
CPC ..... *A63B 37/0092* (2013.01); *A63B 37/004* (2013.01); *A63B 37/006* (2013.01); *A63B 37/0031* (2013.01); *A63B 37/0033* (2013.01); *A63B 37/0037* (2013.01); *A63B 37/0039* (2013.01); *A63B 37/0043* (2013.01); (Continued)

(58) Field of Classification Search
CPC ..... A63B 37/0031; A63B 37/0037; A63B 37/0039; A63B 37/0043; A63B 37/0049; A63B 37/0063
See application file for complete search history.

(56) References Cited

U.S. PATENT DOCUMENTS 6,057,403 A * 5/2000 Sullivan ..... A63B 37/0003 473/372
7,429,221 B1 9/2008 Bulpett et al.
(Continued)

FOREIGN PATENT DOCUMENTS

EP 3037137 A1 6/2016
JP 10-328326 A 12/1998
(Continued)

OTHER PUBLICATIONS

Shore Durometer Conversion Chart—Thermal Tech Equipment Co. Inc.*
Extended European Search Report for European Application No. 16166583.1, dated Aug. 22, 2016.

*Primary Examiner* — John E Simms, Jr.
(74) *Attorney, Agent, or Firm* — Birch, Stewart, Kolasch & Birch, LLP

(57) ABSTRACT

Provided is a golf ball comprising a spherical core including an inner layer and an outer layer, an intermediate layer and a cover, wherein a difference ($H_{X+1}-H_{X-1}$) is 0 or more in Shore C hardness, a surface hardness ($H_{X+Y}$) of the spherical core is more than 70 in Shore C hardness, an angle α of a hardness gradient of the inner layer is 0° or more, a difference (α−β) between the angle α and an angle β of a hardness gradient of the outer layer is 0° or more, the intermediate layer has a material hardness (Hm) ranging from 65 to 80 in Shore D hardness, and the intermediate layer has a highest hardness among the constituent members of the golf ball.

20 Claims, 3 Drawing Sheets

(52) U.S. Cl.
CPC ..... *A63B 37/0044* (2013.01); *A63B 37/0045* (2013.01); *A63B 37/0049* (2013.01); *A63B 37/0062* (2013.01); *A63B 37/0063* (2013.01); *A63B 37/0064* (2013.01); *A63B 37/0076* (2013.01)

(56) References Cited

U.S. PATENT DOCUMENTS

| | | | | |
|---|---|---|---|---|
| 2003/0060307 | A1 | 3/2003 | Umezawa et al. | |
| 2003/0130065 | A1 | 7/2003 | Watanabe | |
| 2006/0229143 | A1 | 10/2006 | Watanabe et al. | |
| 2007/0259739 | A1 | 11/2007 | Kasashima et al. | |
| 2008/0161132 | A1 | 7/2008 | Sullivan et al. | |
| 2009/0011863 | A1 | 1/2009 | Bulpett et al. | |
| 2010/0009776 | A1* | 1/2010 | Okabe | A63B 37/0003 473/373 |
| 2010/0069174 | A1* | 3/2010 | Ohama | A63B 37/0003 473/376 |
| 2010/0167841 | A1* | 7/2010 | Okabe | A63B 37/0003 473/373 |
| 2012/0046128 | A1* | 2/2012 | Liu | A63B 37/0003 473/376 |
| 2012/0094783 | A1* | 4/2012 | Okabe | A63B 37/0039 473/373 |
| 2012/0157235 | A1 | 6/2012 | Kimura | |
| 2012/0252604 | A1* | 10/2012 | Okabe | A63B 37/0063 473/376 |
| 2012/0329576 | A1 | 12/2012 | Sullivan et al. | |
| 2013/0316851 | A1* | 11/2013 | Sajima | A63B 37/0039 473/373 |
| 2015/0119170 | A1 | 4/2015 | Tachibana et al. | |
| 2016/0184657 | A1 | 6/2016 | Tachibana et al. | |
| 2016/0287947 | A1* | 10/2016 | Sullivan | C08L 75/00 |

FOREIGN PATENT DOCUMENTS

| | | | |
|---|---|---|---|
| JP | 10-328328 | A | 12/1998 |
| JP | 11-206920 | A | 8/1999 |
| JP | 2000-60997 | A | 2/2000 |
| JP | 2003-190331 | A | 7/2003 |
| JP | 2006-289065 | A | 10/2006 |
| JP | 2007-190382 | A | 8/2007 |
| JP | 2009-34518 | A | 2/2009 |
| JP | 2009-34519 | A | 2/2009 |
| JP | 2009-219871 | A | 10/2009 |
| JP | 4816847 | B2 | 11/2011 |
| JP | 2012-130676 | A | 7/2012 |

* cited by examiner

GOLF BALL

FIELD OF THE INVENTION

The present invention relates to a golf ball.

DESCRIPTION OF THE RELATED ART

A golfer's foremost requirement for a golf ball is flight performance. In particular, the golfer places importance on the flight performance on driver shots. The flight performance correlates with resilience performance of the golf ball. When a golf ball having an excellent resilience performance is hit, the golf ball flies at a high speed, thereby achieving a long flight distance.

An appropriate trajectory height is required in order to achieve a long flight distance. The trajectory height depends on a spin rate and a launch angle. The golf ball that achieves a high trajectory by a high spin rate travels an insufficient flight distance. The golf ball that achieves a high trajectory by a high launch angle travels a long flight distance. If a core having an outer-hard and inner-soft structure is adopted, a low spin rate and a high launch angle are achieved.

For example, Japanese Patent Publications No. H11-206920 A, No. 2003-190331 A, No. 2006-289065 A, No. 2007-190382 A, No. H10-328326 A, No. H10-328328 A, No. 2000-060997 A, and No. 2009-219871 A disclose golf balls for which the hardness distribution or outer diameter of a two-layered core has been discussed from the standpoint of achieving various performances. Japanese Patent Publication No. H11-206920 A discloses a multi-piece solid golf ball having a multiple-layered construction including: an elastic rubber having an inner layer and an outer layer as a core, and a hard elastic body as a cover layer, wherein the inner layer of the core has a diameter of 20 to 35 mm and a surface hardness (Shore D) of 30 to 50, the outer layer of the core has a thickness of 2 to 11 mm and a surface hardness (Shore D) of 35 to 60, the hardness decreases from the surface of the outer layer toward the central point of the core, and a hardness difference at a boundary interface between the inner layer and the outer layer of the core is 7 or less. (refer to Japanese Patent Publication No. H11-206920 A (claim 1)).

Japanese Patent Publication No. 2003-190331 A discloses a three-piece solid golf ball comprising an inner layer core formed from a rubber composition, an outer layer core formed from a rubber composition and covering the inner layer core, and a cover covering the outer layer core, wherein a JIS-C hardness of the inner layer core is within a range from 50 to 85, a JIS-C hardness of the outer layer core is within a range from 70 to 90, and a difference ($H_o$–$H_1$) between a JIS-C hardness $H_o$ at a surface of the outer layer core and a JIS-C hardness $H_1$ at a central point of the inner layer core is 20 to 30 (refer to Japanese Patent Publication No. 2003-190331 A (claim 1)).

Japanese Patent Publication No. 2006-289065 A discloses a multi-piece solid golf ball comprising a core composed of multiple layers including at least an inner layer core and an outer layer core, and one or at least two cover layers covering the core, wherein (JIS-C hardness of cover)−(JIS-C hardness at central point of core)≥27; 23≤(JIS-C hardness at surface of core)−(JIS-C hardness at central point of core) ≤40; and 0.50≤[(flexure hardness of entire core)/(flexure hardness of inner layer core)]≤0.75 are satisfied (refer to Japanese Patent Publication No. 2006-289065 A (claim 1)).

Japanese Patent Publication No. 2007-190382 A discloses a golf ball comprising a central portion formed as an elastic solid core, wherein the core is harder at an outer portion thereof than at a center portion thereof, a JIS-C hardness difference between the core center portion and the core outer surface is 25 or more, the core has a double-layered construction composed of an inner layer and an outer layer, and the outer layer has a thickness of 5 to 15 mm (refer to Japanese Patent Publication No. 2007-190382 A (claims 2 to 4)).

Japanese Patent Publications No. H10-328326 A and No. H10-328328 A disclose a multi-piece solid golf ball comprising a core and a cover covering the core, wherein the core includes an inner core sphere and an envelope layer covering the inner core sphere, the cover includes an outer layer and an inner layer, a surface hardness of the envelope layer is higher than a surface hardness of the inner core sphere in Shore D, and a hardness of the inner core sphere is 3.0 to 8.0 mm in a deformation amount when a load of 100 kg is applied (refer to Japanese Patent Publications No. H10-328326 A (claim 1) and No. H10-328328 A (claim 1)).

Japanese Patent Publication No. 2000-060997 A discloses a multi-piece solid golf ball comprising a solid core, at least one envelope layer covering the core, an intermediate layer covering the envelope layer, and at least one cover layer covering the intermediate layer, wherein the hardness of the solid core is 2.5 to 7.0 mm in a deformation amount when a load of 100 kg is applied (refer to Japanese Patent Publication No. 2000-060997 A (claim 1)).

Japanese Patent Publication No. 2009-219871 A discloses a golf ball comprising a center, an outer core layer, an inner cover layer, and an outer cover layer, wherein the center is formed from a first rubber composition, has a diameter of 3.05 cm to 3.30 cm, and has a central hardness of 50 Shore C or more; the outer core layer is formed from a second rubber composition, and has a surface hardness of 75 Shore C or more; the inner cover layer is formed from a thermoplastic composition, and has a material hardness lower than the surface hardness of the outer core layer; and the outer cover layer is formed from a polyurethane or polyurea composition (refer to Japanese Patent Publication No. 2009-219871 A (claim 1)).

In addition, for example, Japanese Patent Publications No. 2009-034518 A and No. 2009-034519 A disclose the relationship between hardness gradients of an inner layer core and an outer layer core. Japanese Patent Publication No. 2009-034518 A discloses a golf ball comprising an inner core, an outer core layer and a cover, wherein the inner core has a first outer surface and a geometric center, is formed as a whole from a first substantially uniform formulation, and has a hardness of 60 Shore C to 90 Shore C; the outer core layer has a second outer surface and an inner surface, is formed as a whole from a second substantially uniform formulation, and has a hardness of 45 Shore C to 70 Shore C; each of the geometric center, the first and second outer surfaces, and the inner surface has a hardness, the hardness of the first outer surface is greater than the hardness of the geometric center to define a positive hardness gradient, and the hardness of the second outer surface is substantially equal to or less than the hardness of the inner surface to define a negative hardness gradient (refer to Japanese Patent Publication No. 2009-034518 A (claim 6)).

Japanese Patent Publication No. 2009-034519 A discloses a golf ball comprising an inner core, an outer core layer disposed around the inner core, and a cover disposed around the outer core layer, wherein the inner core has a first outer surface and a geometric center, is formed as a whole from a first substantially uniform formulation, and has a hardness of 45 Shore C to 65 Shore C; the outer core layer has a second outer surface and an inner surface, is formed as a whole from a second substantially uniform formulation, and has a hardness of 55 Shore C to 90 Shore C; each of the geometric center, the first and second outer surfaces, and the inner surface has a hardness, the hardness of the first outer surface is substantially equal to or less than the hardness of the geometric center to define a negative hardness gradient, and the hardness of the second outer surface is greater than the hardness of the inner surface to define a positive hardness gradient (refer to Japanese Patent Publication No. 2009-034519 A (claim 1)).

In addition, various constructions have been proposed for a golf ball comprising three pieces or more, depending on the required performances. For example, as a golf ball showing a good balance between the flight distance and the controllability performance, a golf ball having a hardest intermediate layer material hardness among the constituent members thereof and a soft cover hardness has been proposed. In such a golf ball, a high hardness resin such as an ionomer resin is mainly used as the intermediate layer material, and a low hardness resin such as a urethane resin is mainly used as the cover material.

For example, Japanese Patent Publication No. 4816847 B discloses a multi-piece solid golf ball comprising an elastic solid core covered with a resin cover having a plurality of dimples thereon and a resin intermediate layer disposed between the elastic solid core and the cover, wherein when a deformation amount of the elastic solid core is defined as A, a deformation amount of a spherical body having the elastic solid core and the intermediate layer formed on the elastic solid core is defined as B, and a deformation amount of the golf ball is defined as C, the deformation amount of each of the spherical bodies being a deformation amount (mm) obtained when increasing a load applied thereon from a state of 98 N (10 kgf) to 1274 N (130 kgf), relationships of $1.14 \leq A/B \leq 1.30$ and $1.055 \leq B/C \leq 1.16$ are satisfied; the intermediate layer has a Shore D hardness ranging from 58 to 68; and the cover is formed in a softer hardness than the intermediate layer and a Shore D hardness difference between the cover and the intermediate layer ranges from 7 to 16 (refer to Japanese Patent Publication No. 4816847 B (claim 1)).

Japanese Patent Publication No. 2012-130676 A discloses a multi-piece solid golf ball comprising a core, at least one intermediate layer covering the core, and at least one cover covering the intermediate layer, wherein the core is formed from a base rubber, each layer of the intermediate layer and the cover is formed from a resin material, a ratio (a)/(b) of a thickness (a) of the intermediate layer to a thickness (b) of the cover ranges from 0.7 to 1.9, a ratio (c)/(a) of a diameter (c) of the core to the thickness (a) of the intermediate layer ranges from 23 to 38, the intermediate layer has a material hardness ranging from 42 to 76 in Shore D hardness, the cover has a material hardness ranging from 41 to 69 in Shore D hardness, and a relationship of material hardness of cover<material hardness of intermediate layer>surface hardness of core is satisfied (refer to Japanese Patent Publication No. 2012-130676 A (claim 1)).

In addition, as a golf ball for an average golfer, a golf ball specialized for a flight distance on driver shots has been proposed. As such a golf ball, a golf ball having a hardest cover material hardness among constituent members thereof and a relatively soft intermediate layer material hardness has been proposed. Such a golf ball shows an improved shot feeling since the intermediate layer material is soft, even if the high hardness cover lowers the shot feeling.

SUMMARY OF THE INVENTION

As described above, various constructions have been proposed for the golf ball. However, there is still room for improvement in the flight distance on driver shots. For example, especially in a golf ball for an average golfer, if the hardness of the intermediate layer is soft, there is a problem that a flight distance is lowered due to an increased spin rate on driver shots. The present invention has been achieved in view of the above circumstances, and an object of the present invention is to provide a golf ball traveling a great distance on driver shots.

The golf ball according to the present invention that has solved the above problems comprises a spherical core, an intermediate layer positioned outside the spherical core, and a cover positioned outside the intermediate layer, wherein the spherical core includes an inner layer and an outer layer, a difference ($H_{X+1}-H_{X-1}$) between a hardness ($H_{X+1}$) at a point outwardly away in a radial direction from a boundary between the inner layer and the outer layer of the spherical core by 1 mm and a hardness ($H_{X-1}$) at a point inwardly away in the radial direction from the boundary between the inner layer and the outer layer of the spherical core by 1 mm is 0 or more in Shore C hardness, a surface hardness ($H_{X+Y}$) of the spherical core is more than 70 in Shore C hardness, an angle $\alpha$ of a hardness gradient of the inner layer calculated by a formula (1) is 0° or more, a difference ($\alpha-\beta$) between the angle $\alpha$ and an angle $\beta$ of a hardness gradient of the outer layer calculated by a formula (2) is 0° or more, the intermediate layer has a material hardness (Hm) ranging from 65 to 80 in Shore D hardness, and the intermediate layer has a highest hardness among the constituent members of the golf ball.

$$\alpha=(180/\pi)\times a\tan[\{H_{x-1}-Ho\}/(X-1)] \quad (1)$$

$$\beta=(180/\pi)\times a\tan[\{H_{X+Y}-H_{x+1}\}/(Y-1)] \quad (2)$$

[where X represents a radius (mm) of the inner layer, Y represents a thickness (mm) of the outer layer, Ho represents a center hardness (Shore C) of the spherical core, $H_{X-1}$ represents the hardness (Shore C) at the point inwardly away in the radial direction from the boundary between the inner layer and the outer layer of the spherical core by 1 mm, $H_{X+1}$ represents the hardness (Shore C) at the point outwardly away in the radial direction from the boundary between the inner layer and the outer layer of the spherical core by 1 mm, and $H_{X+Y}$ represents the surface hardness (Shore C) of the spherical core].

In the golf ball according to the present invention, the relationship between the hardness gradient of the inner layer and the hardness gradient of the outer layer of the spherical core, the relationship between the inner layer hardness and the outer layer hardness near the boundary between the inner layer and the outer layer of the spherical core, and the hardness of the intermediate layer are optimized. As a result, for the golf ball according to the present invention, the ball initial velocity on driver shots is increased and the excessive spin rate on driver shots is suppressed. Therefore, the golf ball according to the present invention travels a greater distance on driver shots.

The golf ball according to the present invention travels a great distance on driver shots.

DESCRIPTION OF THE PREFERRED EMBODIMENT

Figure 1:
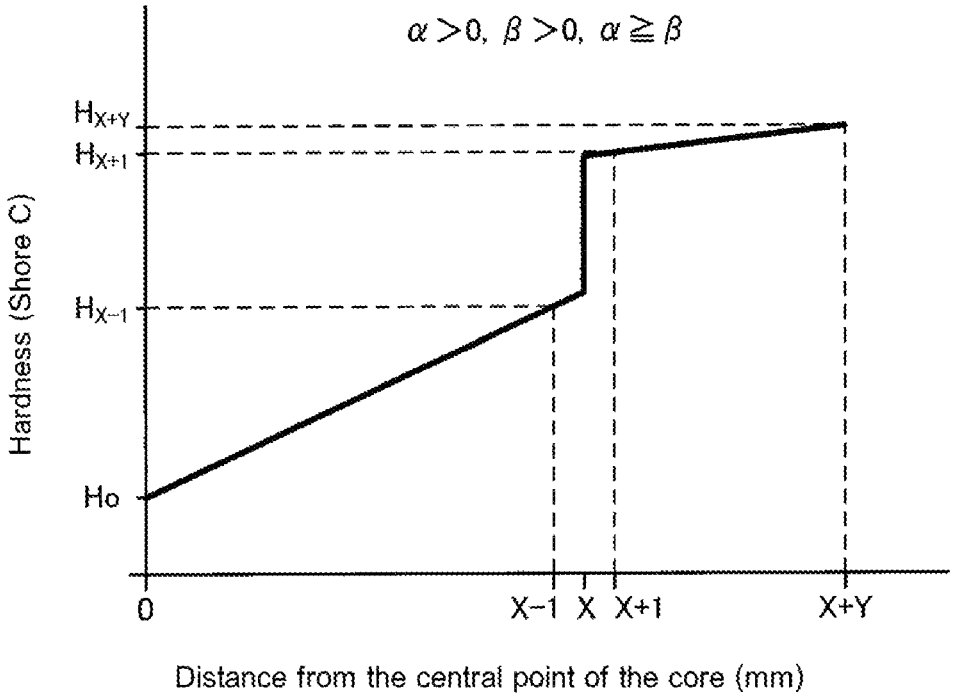
FIG. 1 is a drawing showing one example of a hardness distribution of a spherical core.
Figure 2:
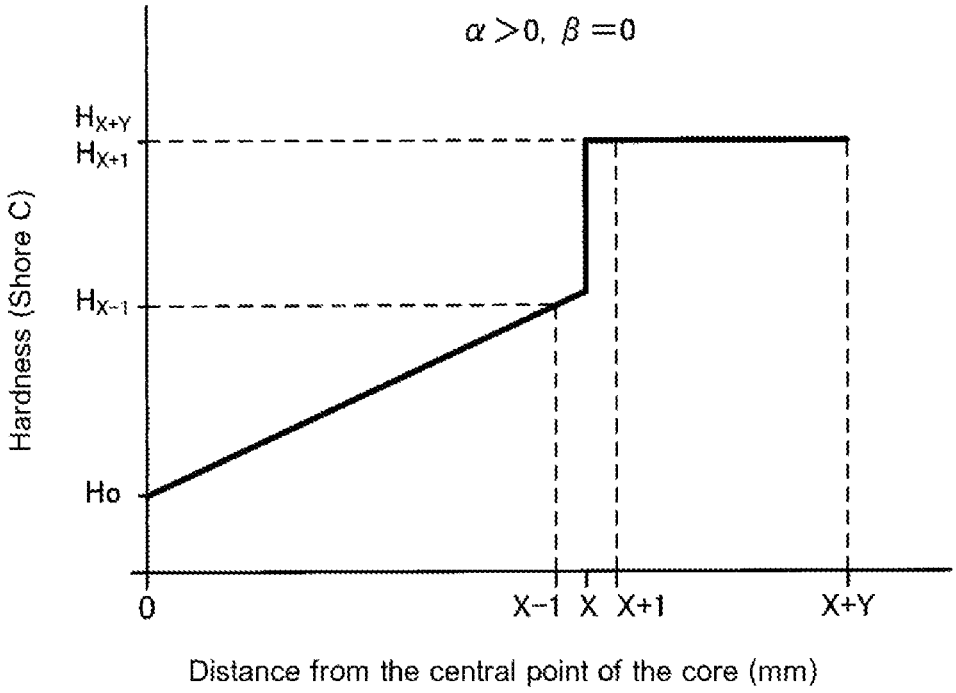
FIG. 2 is a drawing showing another example of a hardness distribution of a spherical core.
Figure 3:
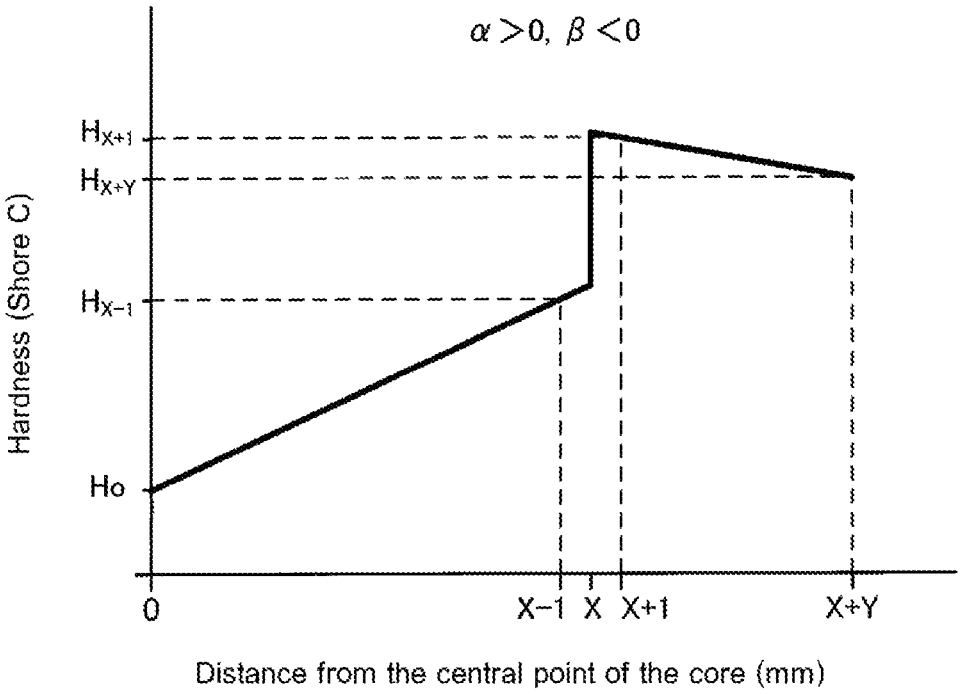
FIG. 3 is a drawing showing another example of a hardness distribution of a spherical core.
Figure 4:
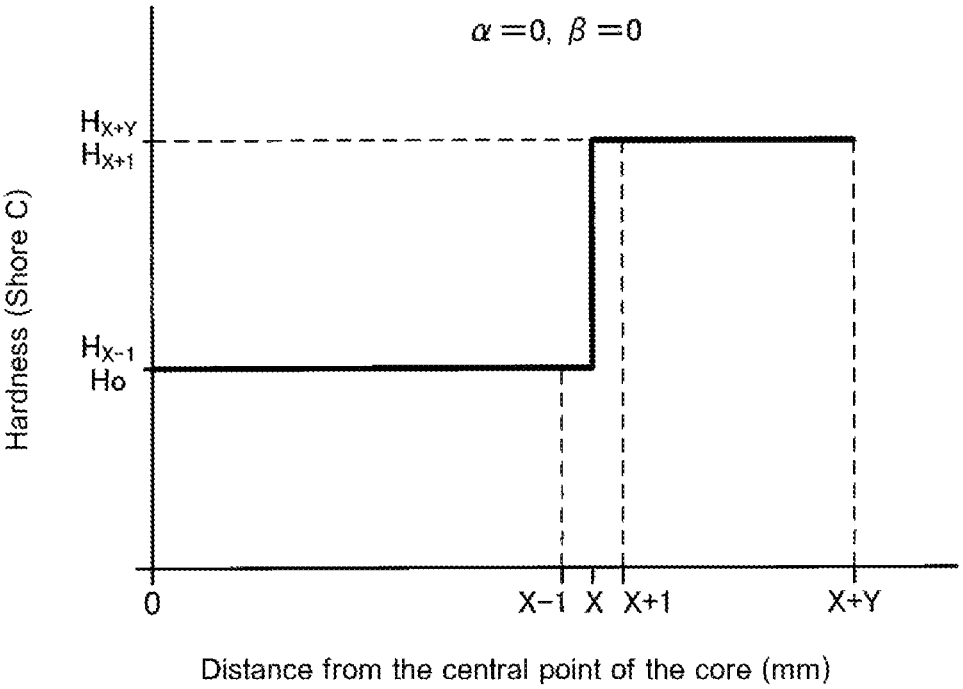
FIG. 4 is a drawing showing another example of a hardness distribution of a spherical core.

The golf ball according to the present invention comprises a spherical core, an intermediate layer positioned outside the spherical core, and a cover positioned outside the intermediate layer, wherein the spherical core includes an inner layer and an outer layer, a difference ($H_{X+1}-H_{X-1}$) between a hardness ($H_{X+1}$) at a point outwardly away in a radial direction from a boundary between the inner layer and the outer layer of the spherical core by 1 mm and a hardness ($H_{X-1}$) at a point inwardly away in the radial direction from the boundary between the inner layer and the outer layer of the spherical core by 1 mm is 0 or more in Shore C hardness, a surface hardness ($H_{X+Y}$) of the spherical core is more than 70 in Shore C hardness, an angle α of a hardness gradient of the inner layer calculated by a formula (1) is 0° or more, a difference (α−β) between the angle α and an angle β of a hardness gradient of the outer layer calculated by a formula (2) is 0° or more, the intermediate layer has a material hardness (Hm) ranging from 65 to 80 in Shore D hardness, and the intermediate layer has a highest hardness among the constituent members of the golf ball.

$$\alpha=(180/\pi)\times a\tan[\{H_{x-1}-Ho\}/(X-1)] \quad (1)$$

$$\beta=(180/\pi)\times a\tan[\{H_{X+Y}-H_{x+1}\}/(Y-1)] \quad (2)$$

[where X represents a radius (mm) of the inner layer, Y represents a thickness (mm) of the outer layer, Ho represents a center hardness (Shore C) of the spherical core, $H_{X+Y}$ represents the hardness (Shore C) at the point inwardly away in the radial direction from the boundary between the inner layer and the outer layer of the spherical core by 1 mm, $H_{X+1}$ represents the hardness (Shore C) at the point outwardly away in the radial direction from the boundary between the inner layer and the outer layer of the spherical core by 1 mm, and $H_{X+Y}$ represents the surface hardness (Shore C) of the spherical core].

With such a configuration, the ball initial velocity can be increased while suppressing the excessive spin rate on driver shots.

[Construction]

(Spherical Core)

The spherical core includes a two-layered construction consisting of an inner layer and an outer layer. The spherical core is preferably formed from a rubber composition.

(Hardness Ho)

The center hardness Ho is a hardness (Shore C) measured at the central point of the cut plane obtained by cutting the spherical core into two hemispheres. The hardness Ho is preferably 48 or more, more preferably 49 or more, and even more preferably 50 or more, and is preferably less than 70, more preferably 68 or less, and even more preferably 67 or less. If the hardness Ho is 48 or more, the resilience performance is further enhanced, and if the hardness Ho is less than 70, the excessive spin rate on driver shots is suppressed.

(Hardness $H_{X-1}$)

The hardness $H_{X-1}$ is a hardness (Shore C) measured at the point inwardly away in the radial direction from the boundary between the inner layer and the outer layer by 1 mm on the cut plane obtained by cutting the spherical core into two hemispheres. In other words, the hardness $H_{X-1}$ is a hardness measured at a point having a distance of X−1 (mm) from the central point. The hardness $H_{X-1}$ is preferably 63 or more, more preferably 65 or more, and even more preferably 67 or more, and is preferably 82 or less, more preferably 80 or less, and even more preferably 78 or less. If the hardness $H_{X-1}$ is 63 or more, the resilience performance is enhanced, and if the hardness $H_{X-1}$ is 82 or less, the excessive spin rate on driver shots is suppressed.

(Hardness $H_{X+1}$)

The hardness $H_{X+1}$ is a hardness (Shore C) measured at the point outwardly away in the radial direction from the boundary between the inner layer and the outer layer by 1 mm on the cut plane obtained by cutting the spherical core into two hemispheres. In other words, the hardness $H_{X+1}$ is a hardness measured at a point having a distance of X+1 (mm) from the central point. The hardness $H_{X+1}$ is preferably 70 or more, more preferably 73 or more, and even more preferably 75 or more, and is preferably 90 or less, more preferably 88 or less, and even more preferably 86 or less. If the hardness $H_{X+1}$ is 70 or more, the resilience performance is enhanced, and if the hardness $H_{X+1}$ is 90 or less, the feeling becomes better.

(Hardness $H_{X+Y}$)

The hardness $H_{X+Y}$ is a hardness (Shore C) measured at the surface of the spherical core (outer core). The hardness $H_{X+Y}$ is preferably 70 or more, more preferably 73 or more, and even more preferably 75 or more, and is preferably 90 or less, more preferably 88 or less, and even more preferably 86 or less. If the hardness $H_{X+Y}$ is 70 or more, the resilience performance is enhanced, and if the hardness $H_{X+Y}$ is 90 or less, the feeling becomes better.

(Hardness Difference ($H_{X-1}$−Ho))

The hardness difference ($H_{X-1}$−Ho) between the center hardness Ho and the hardness $H_{X-1}$, i.e. the hardness difference between the center hardness of the inner layer and the hardness of the inner layer near the boundary is preferably 4 or more, more preferably 5 or more, and even more preferably 6 or more, and is preferably 27 or less, more preferably 26 or less, and even more preferably 25 or less. If the hardness difference ($H_{X-1}$−Ho) is 4 or more, the excessive spin rate on driver shots is suppressed, and if the hardness difference ($H_{X-1}$−Ho) is 27 or less, the resilience performance is enhanced.

(Hardness Difference ($H_{X+1}-H_{X-1}$)))

The hardness difference ($H_{X+1}-H_{X-1}$) between the hardness $H_{X-1}$ and the hardness $H_{X+1}$, i.e. the hardness difference between the inner layer hardness and the outer layer hardness near the boundary between the inner layer and the outer layer is preferably 0 or more, more preferably 5 or more, even more preferably 7 or more, and particularly preferably 8 or more, and is preferably 20 or less, more preferably 18 or less, and even more preferably 16 or less. If the hardness difference ($H_{X+1}-H_{X-1}$) is 0 or more, the excessive spin rate on driver shots is suppressed, and if the hardness difference ($H_{X+1}-H_{X-1}$) is 20 or less, the durability is enhanced.

(Hardness Difference ($H_{X+Y}-H_{X+1}$))

The hardness difference ($H_{X+Y}-H_{X+1}$) between the hardness $H_{X+1}$ and the surface hardness $H_{X+Y}$, i.e. the hardness difference between the outer layer hardness near the boundary and the surface hardness of the outer layer is preferably −7 or more, more preferably −6 or more, and even more preferably −5 or more, and is preferably 10 or less, more preferably 7 or less, and even more preferably 5 or less. If the hardness difference ($H_{X+Y}$–$H_{X+1}$) is −7 or more, the excessive spin rate on driver shots is suppressed, and if the hardness difference ($H_{X+Y}$–$H_{X+1}$) is 10 or less, the resilience performance is enhanced.

(Hardness difference ($H_{X+Y}$–Ho))

The hardness difference ($H_{X+Y}$–Ho) between the center hardness Ho and the surface hardness $H_{X+Y}$, i.e. the hardness difference between the center hardness and the surface hardness of the spherical core is preferably 14 or more, more preferably 16 or more, and even more preferably 18 or more, and is preferably 35 or less, more preferably 33 or less, and even more preferably 30 or less. If the hardness difference ($H_{X+Y}$–Ho) is 14 or more, the excessive spin rate on driver shots is suppressed, and if the hardness difference ($H_{X+Y}$–Ho) is 35 or less, the durability is enhanced.

(Angle α)

The angle α is calculated by a formula (1). The angle α(°) represents a hardness gradient of the inner layer. The angle α is preferably 0° or more, more preferably 15° or more, and even more preferably 20° or more, and is preferably 75° or less, more preferably 73° or less, and even more preferably 70° or less. If the angle α is 0° or more, the excessive spin rate on driver shots is suppressed, and if the angle α is 75° or less, the resilience performance is enhanced.

(Angle β)

The angle β is calculated by a formula (2). The angle β(°) represents a hardness gradient of the outer layer. The angle β is preferably −20° or more, more preferably −19° or more, and even more preferably −18° or more, and is preferably +20° or less, more preferably +19° or less, and even more preferably +18° or less. If the angle β is −20° or more, the excessive spin rate on driver shots is suppressed, and if the angle β is +20° or less, the resilience performance is enhanced.

(Angle Difference (α−β))

Figure 5:
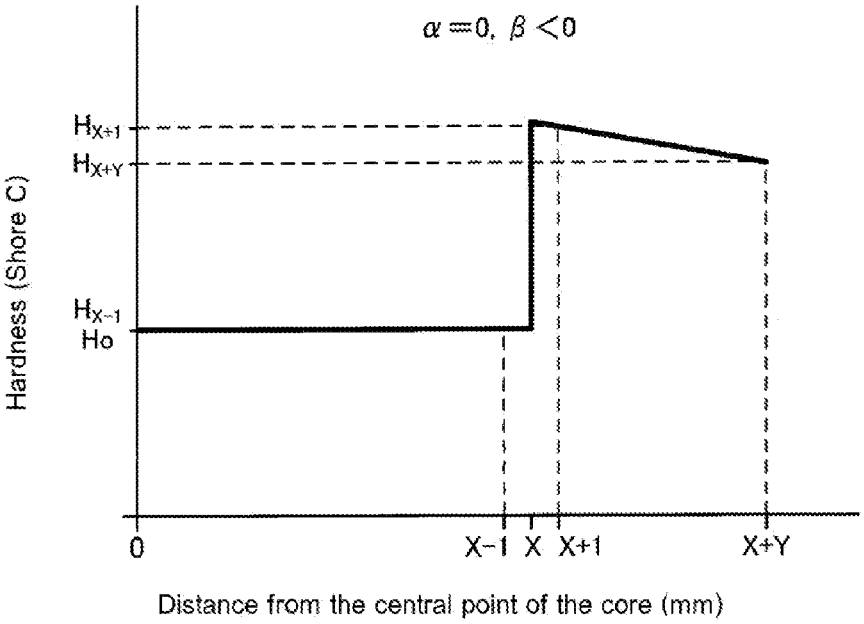
FIG. 5 is a drawing showing another example of a hardness distribution of a spherical core.

The difference (α−β) between the angle α and the angle β is 0° or more. Examples of the embodiment in which the difference (α−β) is 0° or more are shown in FIG. 1 to FIG. 5. FIG. 1 to FIG. 5 show examples of the hardness distribution of the spherical core. Examples of the embodiment in which the difference (α−β) is 0° or more include an embodiment in which the angle α and the angle β are positive, and the angle β is equal to or less than the angle α (FIG. 1); an embodiment in which the angle α is positive and the angle β is 0° (FIG. 2); an embodiment in which the angle α is positive and the angle β is negative (FIG. 3); an embodiment in which both the angle α and the angle β are 0° (FIG. 4); and an embodiment in which the angle α is 0° and the angle β is negative (FIG. 5). With such a configuration, the ball initial velocity can be increased while suppressing the excessive spin rate on driver shots. The difference (α−β) is preferably 5 or more, more preferably 10 or more, and is preferably 85 or less, more preferably 80 or less, and even more preferably 75 or less. If the difference (α−β) is 85 or less, the resilience performance is enhanced.

(Radius X of Inner Layer)

The radius X is the radius (mm) of the inner layer of the core. The inner layer of the core preferably has a spherical shape. The radius X is preferably 7 mm or more, more preferably 9 mm or more, and even more preferably 10 mm or more, and is preferably 16 mm or less, more preferably 15 mm or less, and even more preferably 14 mm or less. If the radius X is 7 mm or more, the excessive spin rate on driver shots can be suppressed, and if the radius X is 16 mm or less, the resilience performance is enhanced.

(Thickness Y of Outer Layer)

The thickness Y is the thickness (mm) of the outer layer of the core. The thickness Y is preferably 3 mm or more, more preferably 4 mm or more, and even more preferably 5 mm or more, and is preferably 12 mm or less, more preferably 11 mm or less, and even more preferably 10 mm or less. If the thickness Y is 3 mm or more, the resilience performance becomes better, and if the thickness Y is 12 mm or less, the excessive spin rate on driver shots is suppressed.

(Ratio (Y/X))

The ratio (Y/X) of the thickness Y to the radius X is preferably 0.2 or more, more preferably 0.3 or more, and even more preferably 0.4 or more, and is preferably 2.0 or less, more preferably 1.7 or less, and even more preferably 1.5 or less. If the ratio (Y/X) is 0.2 or more, the resilience performance becomes better, and if the ratio (Y/X) is 2.0 or less, the excessive spin rate on driver shots is suppressed.

(Cross-Sectional Area S1)

The cross-sectional area S1 ($mm^2$) of the inner layer of the spherical core on the cut plane obtained by cutting the spherical core into two hemispheres is preferably 200 $mm^2$ or more, more preferably 250 $mm^2$ or more, and even more preferably 300 $mm^2$ or more, and is preferably 800 $mm^2$ or less, more preferably 700 $mm^2$ or less, and even more preferably 600 $mm^2$ or less. If the cross-sectional area S1 is 200 $mm^2$ or more, the resilience performance becomes better, and if the cross-sectional area S1 is 800 $mm^2$ or less, the excessive spin rate on driver shots is suppressed.

(Cross-Sectional Area S2)

The cross-sectional area S2 ($mm^2$) of the outer layer of the spherical core on the cut plane obtained by cutting the spherical core into two hemispheres is preferably 500 $mm^2$ or more, more preferably 550 $mm^2$ or more, and even more preferably 600 $mm^2$ or more, and is preferably 1000 $mm^2$ or less, more preferably 950 $mm^2$ or less, and even more preferably 900 $mm^2$ or less. If the cross-sectional area S2 is 500 $mm^2$ or more, the resilience performance becomes better, and if the cross-sectional area S2 is 1000 $mm^2$ or less, the excessive spin rate on driver shots is suppressed.

(Ratio (S2/S1))

The ratio (S2/S1) of the cross-sectional area S2 ($mm^2$) of the outer layer to the cross-sectional area S1 ($mm^2$) of the inner layer is preferably 0.5 or more, more preferably 0.6 or more, and even more preferably 0.7 or more, and is preferably 6.0 or less, more preferably 5.0 or less, and even more preferably 4.0 or less. If the ratio (S2/S1) is 0.5 or more, the resilience performance becomes better, and if the ratio (S2/S1) is 6.0 or less, the excessive spin rate on driver shots is suppressed.

(Volume V1)

The volume V1 ($mm^3$) of the inner layer of the spherical core is preferably 2000 $mm^3$ or more, more preferably 3000 $mm^3$ or more, and even more preferably 4000 $mm^3$ or more, and is preferably 17000 $mm^3$ or less, more preferably 14000 $mm^3$ or less, and even more preferably 12000 $mm^3$ or less. If the volume V1 is 2000 $mm^3$ or more, the resilience performance becomes better, and if the volume V1 is 17000 $mm^3$ or less, the excessive spin rate on driver shots is suppressed.

(Volume V2)

The volume V2 ($mm^3$) of the outer layer of the spherical core is preferably 15000 $mm^3$ or more, more preferably 16000 $mm^3$ or more, and even more preferably 17000 $mm^3$ or more, and is preferably 30000 $mm^3$ or less, more preferably 29000 $mm^3$ or less, and even more preferably 28000 $mm^3$ or less. If the volume V2 is 15000 $mm^3$ or more, the resilience performance becomes better, and if the volume V2 is 30000 $mm^3$ or less, the excessive spin rate on driver shots is suppressed.

(Ratio (V2/V1))

The ratio (V2N1) of the volume V2 ($mm^3$) of the outer layer to the volume V1 ($mm^3$) of the inner layer is preferably 1.0 or more, more preferably 1.3 or more, and even more preferably 1.5 or more, and is preferably 20.0 or less, more preferably 15 or less, and even more preferably 12 or less. If the ratio (V2N1) is 1.0 or more, the resilience performance becomes better, and if the ratio (V2N1) is 20.0 or less, the excessive spin rate on driver shots is suppressed.

The diameter of the spherical core is preferably 36.5 mm or more, more preferably 37.0 mm or more, and even more preferably 37.5 mm or more, and is preferably 42.0 mm or less, more preferably 41.0 mm or less, and even more preferably 40.2 mm or less. If the diameter of the spherical core is 36.5 mm or more, the spherical core is big and thus the resilience performance of the golf ball is further enhanced.

When the spherical core has a diameter ranging from 36.5 mm to 42.0 mm, the compression deformation amount of the core (shrinking amount of the core along the compression direction) when applying a load from 98 N as an initial load to 1275 N as a final load to the core is preferably 2.0 mm or more, more preferably 2.5 mm or more, and is preferably 4.8 mm or less, more preferably 4.5 mm or less. If the compression deformation amount is 2.0 mm or more, the shot feeling becomes better, and if the compression deformation amount is 4.8 mm or less, the resilience performance becomes better.

(Intermediate Layer)

The golf ball comprises an intermediate layer positioned outside the spherical core. The intermediate layer is disposed between the spherical core and the cover, and formed from a resin composition. The intermediate layer may comprise a single layer, or two or more layers. In the case that the intermediate layer comprises multiple layers, the material hardness (Hm) of the intermediate layer is a material hardness of a resin composition for forming an outermost intermediate layer, and the surface hardness of the intermediate layer is a surface hardness of the outermost intermediate layer.

The intermediate layer has a highest hardness among the constituent members of the golf ball. In other words, the material hardness Hm of the intermediate layer is highest among the center hardness Ho of the spherical core, the hardness $H_{X+1}$ at the point outwardly away in the radial direction from the boundary between the inner layer and the outer layer of the spherical core by 1 mm, the hardness $H_{X-1}$ at the point inwardly away in the radial direction from the boundary between the inner layer and the outer layer of the spherical core by 1 mm, the surface hardness $H_{X+Y}$ of the spherical core, the material hardness Hm of the intermediate layer and the material hardness Hc of the cover. If the material hardness Hm of the intermediate layer is a highest hardness, the excessive spin rate on driver shots can be suppressed, and thus the golf ball travels a greater distance.

The material hardness (Hm) of the resin composition for forming the intermediate layer is preferably 65 or more, more preferably 67 or more, and even more preferably 69 or more, and is preferably 80 or less, more preferably 78 or less, and even more preferably 76 or less in Shore D hardness. If the material hardness (Hm) is 65 or more in Shore D hardness, the spin rate on driver shots is lowered and thus the flight distance becomes greater. In addition, if the material hardness (Hm) is 80 or less in Shore D hardness, the shot feeling on driver shots becomes better.

In the golf ball, for the surface hardness of an intermediate layer covered-spherical body having the spherical core covered with the intermediate layer, the difference (HmsC−HmsD) thereof between the hardness (HmsC) measured with a Durometer type C prescribed in ASTM D 2240 and the hardness (HmsD) measured with a Durometer type D prescribed in ASTM D 2240 is preferably 27 or less, more preferably 26 or less, and even more preferably 25 or less. The press needle tip of the Durometer type C has a frustum shape (angle: 35°, tip diameter: 0.79 mm), and thus has a wide contact point with the object to be measured. Accordingly, the Shore C hardness is considered to have a high correlation with the feeling. The press needle tip of the Durometer type D has a conical shape (angle: 30°, tip radius: 0.1 mm), and thus has a narrow contact point with the object to be measured. Accordingly, the Shore D hardness is considered to have a high correlation with the original hardness of the material and to have a high correlation with the spin performance.

The surface hardness (HmsC) reflects not only the material hardness of the intermediate layer, but also the surface hardness of the spherical core and the compression deformation amount. This surface hardness (HmsC) has a high correlation with the shot feeling of the golf ball, and a smaller value thereof means a better shot feeling. On the other hand, the surface hardness (HmsD) mainly reflects the effect by the material hardness of the intermediate layer. This surface hardness (HmsD) has a high correlation with the spin rate decrease effect, and a larger value thereof means a greater spin rate decrease effect. Therefore, a smaller value of the difference (HmsC−HmsD) means a better shot feeling and a greater spin rate decrease effect.

The surface hardness (HmsC) of the intermediate layer is preferably 93 or more, more preferably 95 or more, and even more preferably 96 or more, and is preferably 100 or less, more preferably 98 or less, and even more preferably 97 or less. If the surface hardness (HmsC) is 93 or more, the spin rate decrease effect on driver shots becomes greater, and if the surface hardness (HmsC) is 100 or less, the shot feeling on driver shots becomes better.

The surface hardness (HmsD) of the intermediate layer is preferably 66 or more, more preferably 68 or more, and even more preferably 70 or more, and is preferably 80 or less, more preferably 78 or less, and even more preferably 76 or less. If the surface hardness (HmsD) is 66 or more, the spin rate decrease effect on driver shots becomes greater, and if the surface hardness (HmsD) is 80 or less, the shot feeling on driver shots becomes better.

The bending stiffness (Sm) of the resin composition for forming the intermediate layer is preferably 3000 $kgf/cm^2$ (294 MPa) or more, more preferably 3300 $kgf/cm^2$ (324 MPa) or more, and even more preferably 3600 $kgf/cm^2$ (353 MPa) or more, and is preferably 9000 $kgf/cm^2$ (883 MPa) or less, more preferably 8700 $kgf/cm^2$ (853 MPa) or less, and even more preferably 8400 $kgf/cm^2$ (824 MPa) or less. If the bending stiffness (Sm) is 3000 $kgf/cm^2$ or more, the spin rate decrease effect on driver shots becomes greater, and if the bending stiffness (Sm) is 9000 $kgf/cm^2$ or less, the shot feeling on driver shots becomes better.

The intermediate layer preferably has a thickness of 0.7 mm or more, more preferably 0.8 mm or more, and even more preferably 0.9 mm or more, and preferably has a thickness of 1.5 mm or less, more preferably 1.4 mm or less, and even more preferably 1.3 mm or less. If the intermediate layer has a thickness of 0.7 mm or more, the spin rate decrease effect on driver shots becomes greater, and if the intermediate layer has a thickness of 1.5 mm or less, the golf ball has a better shot feeling.

(Cover)

The golf ball comprises a cover positioned outside the intermediate layer. The cover constitutes the outermost layer of the golf ball body, and is formed from a resin composition.

The material hardness (Hc) of the resin composition for forming the cover is preferably 57 or more, more preferably 59 or more, and even more preferably 61 or more, and is preferably 72 or less, more preferably 70 or less, and more preferably 68 or less in shore D hardness. If the material hardness (Hc) is 57 or more in shore D hardness, the resilience of the cover is enhanced, and thus the flight distance on driver shots is increased. In addition, if the material hardness (Hc) is 72 or less in shore D hardness, the shot feeling on driver shots becomes better.

The cover constitutes the outermost layer of the golf ball body, and is formed from a resin composition. In the golf ball according to the present invention, for the surface hardness of the cover, the difference (HcsC−HcsD) thereof between the hardness (HcsC) measured with a Durometer type C prescribed in ASTM D 2240 and the hardness (HcsD) measured with a Durometer type D prescribed in ASTM D 2240 is preferably 27 or more, and more preferably 28 or more. A larger value of the difference (HcsC−HcsD) means a better shot feeling on driver shots.

The surface hardness (HcsC) of the cover is preferably 91 or more, more preferably 92 or more, and even more preferably 93 or more, and is preferably 98 or less, more preferably 97 or less, and even more preferably 96 or less. If the surface hardness (HcsC) is 91 or more, the resilience of the cover is enhanced, and thus the flight distance on driver shots is increased. If the surface hardness (HcsC) is 98 or less, the shot feeling on driver shots becomes better.

The surface hardness (HcsD) of the cover is preferably 58 or more, more preferably 60 or more, and even more preferably 62 or more, and is preferably 72 or less, more preferably 70 or less, and even more preferably 68 or less. If the surface hardness (HcsD) is 58 or more, the spin rate decrease effect on driver shots becomes greater, and if the surface hardness (HcsD) is 72 or less, the shot feeling on driver shots becomes better.

The bending stiffness (Sc) of the resin composition for forming the cover is preferably 1500 kgf/cm$^2$ (147 MPa) or more, more preferably 1800 kgf/cm$^2$ (177 MPa) or more, and even more preferably 2100 kgf/cm$^2$ (206 MPa) or more, and is preferably 6000 kgf/cm$^2$ (588 MPa) or less, more preferably 5700 kgf/cm$^2$ (559 MPa) or less, and even more preferably 5400 kgf/cm$^2$ (530 MPa) or less. If the bending stiffness (Sc) is 1500 kgf/cm$^2$ or more, the resilience of the cover is enhanced, and thus the flight distance on driver shots is increased. If the bending stiffness (Sc) is 6000 kgf/cm$^2$ or less, the shot feeling on driver shots becomes better.

The cover preferably has a thickness of 0.5 mm or more, more preferably 0.6 mm or more, and even more preferably 0.7 mm or more, and preferably has a thickness of 1.3 mm or less, more preferably 1.2 mm or less, and even more preferably 1.1 mm or less. If the cover has a thickness of 0.5 mm or more, the durability of the cover is enhanced, and if the cover has a thickness of 1.3 mm or less, the resilience of the cover is further enhanced.

The difference (Hm−Hc) between the material hardness (Hc) and the material hardness (Hm) is preferably more than 0, more preferably 2 or more, and even more preferably 4 or more, and is preferably 20 or less, more preferably 18 or less, and even more preferably 16 or less in Shore D hardness. If the difference (Hm−Hc) is more than 0, the shot feeling on driver shots becomes better, and if the difference (Hm−Hc) is 20 or less, the spin rate decrease effect on driver shots becomes greater.

The ratio (Sm/Sc) of the bending stiffness (Sm) of the intermediate layer resin composition to the bending stiffness (Sc) of the cover resin composition is preferably 2 or more, more preferably 2.2 or more, and even more preferably 2.4 or more, and is preferably 5 or less, more preferably 4.8 or less, and even more preferably 4.6 or less. If the ratio (Sm/Sc) is 2 or more, the shot feeling on driver shots becomes better, and if the ratio (Sm/Sc) is 5 or less, the spin rate decrease effect on driver shots becomes greater.

The difference (Hm−$H_{x+y}$) between the surface hardness ($H_{x+y}$) of the spherical core and the material hardness (Hm) of the intermediate layer is preferably 10 or more, more preferably 12 or more, and even more preferably 14 or more, and is preferably 30 or less, more preferably 28 or less, and even more preferably 26 or less in Shore C hardness. If the difference (Hm−$H_{x+y}$) is 10 or more, the spin rate decrease effect on driver shots becomes greater, and if the difference (Hm-$H_{x+y}$) is 30 or less, the shot feeling on driver shots becomes better.

The difference (Hc−$H_{x+y}$) between the surface hardness ($H_{x+y}$) of the spherical core and the material hardness (Hc) of the cover is preferably 0 or more, more preferably 2 or more, and even more preferably 4 or more, and is preferably 20 or less, more preferably 18 or less, and even more preferably 16 or less in Shore C hardness. If the difference (Hc−$H_{x+y}$) is 0 or more, the resilience is enhanced and thus the flight distance on driver shots is increased. If the difference (Hc−$H_{x+y}$) is 20 or less, the shot feeling on driver shots becomes better.

(Reinforcing Layer)

The golf ball may comprise a reinforcing layer between the intermediate layer and the cover. If the reinforcing layer is comprised, the adhesion between the intermediate layer and the cover increases, and thus the durability of the golf ball is enhanced. The reinforcing layer preferably has a thickness of 3 μm or more, more preferably 5 μm or more, and preferably has a thickness of 100 μm or less, more preferably 50 μm or less, and even more preferably 20 μm or less.

The golf ball preferably has a diameter ranging from 40 mm to 45 mm. In light of satisfying the regulation of US Golf Association (USGA), the diameter is particularly preferably 42.67 mm or more. In light of prevention of the air resistance, the diameter is more preferably 44 mm or less, and particularly preferably 42.80 mm or less. In addition, the golf ball preferably has a mass of 40 g or more and 50 g or less. In light of obtaining greater inertia, the mass is more preferably 44 g or more, and particularly preferably 45.00 g or more. In light of satisfying the regulation of USGA, the mass is particularly preferably 45.93 g or less.

When the golf ball has a diameter ranging from 40 mm to 45 mm, the compression deformation amount of the golf ball (shrinking amount of the golf ball along the compression direction) when applying a load from 98 N as an initial load to 1275 N as a final load to the golf ball is preferably 1.4 mm or more, more preferably 1.5 mm or more, even more preferably 1.6 mm or more, and most preferably 1.7 mm or more, and is preferably 4 mm or less, more preferably 3.8 mm or less. If the compression deformation amount is 1.4 mm or more, the golf ball does not become excessively hard, and thus the shot feeling thereof is good. On the other hand, if the compression deformation amount is 4 mm or less, the resilience becomes high.

Examples of the golf ball according to the present invention include a four-piece golf ball comprising a two-layered spherical core, a single intermediate layer covering the spherical core, and a cover covering the intermediate layer; a five-piece golf ball comprising a two-layered spherical core, two intermediate layers covering the spherical core, and a cover covering the intermediate layers; and a golf ball having six pieces or more comprising a two-layered spherical core, three or more intermediate layers covering the spherical core, and a cover covering the intermediate layers. The present invention can be applied appropriately to any one of the above golf balls.

Figure 6:
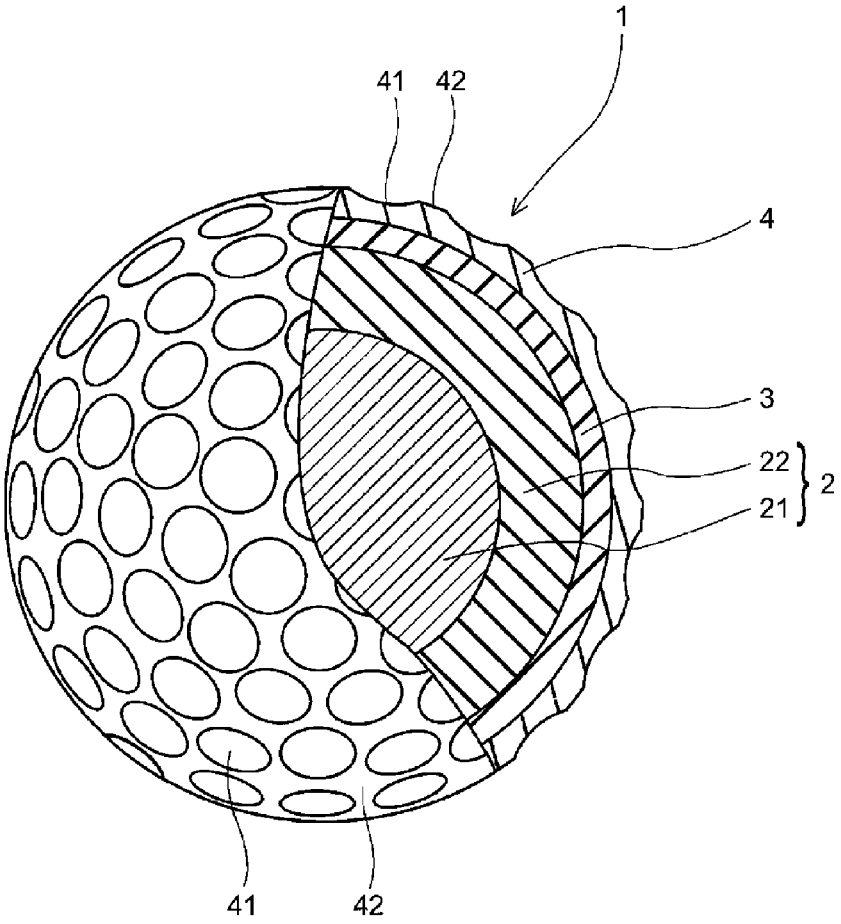
FIG. 6 is a partially cutaway sectional view showing a golf ball of one embodiment according to the present invention.

FIG. 6 is a partially cutaway sectional view showing a golf ball 1 according to one embodiment of the present invention. The golf ball 1 comprises a spherical core 2, an intermediate layer 3 positioned outside the spherical core 2, and a cover 4 positioned outside the intermediate layer 3. The spherical core 2 comprises an inner layer 21 and an outer layer 22 positioned outside the inner layer 21. A plurality of dimples 41 are formed on the surface of the cover 4. Other portions than dimples 41 on the surface of the cover 4 are lands 42.

[Material]

The core, intermediate layer and cover of the golf ball may employ conventionally known materials.

The core may employ a conventionally known rubber composition (hereinafter, sometimes simply referred to as "core rubber composition"), and can be formed by, for example, heat-pressing a rubber composition containing a base rubber, a co-crosslinking agent, and a crosslinking initiator.

As the base rubber, typically preferred is a high cis-polybutadiene having cis-bond in a proportion of 40 mass % or more, more preferably 70 mass % or more, and even more preferably 90 mass % or more in view of its superior resilience property. The co-crosslinking agent is preferably an α,β-unsaturated carboxylic acid having 3 to 8 carbon atoms or a metal salt thereof, and more preferably a metal salt of acrylic acid or a metal salt of methacrylic acid. The metal constituting the metal salt is preferably zinc, magnesium, calcium, aluminum or sodium, more preferably zinc. The amount of the co-crosslinking agent is preferably 20 parts by mass or more and 50 parts by mass or less with respect to 100 parts by mass of the base rubber. When the α,β-unsaturated carboxylic acid having 3 to 8 carbon atoms is used as the co-crosslinking agent, a metal compound (e.g. magnesium oxide) is preferably used in combination. As the crosslinking initiator, an organic peroxide is preferably used. Specific examples of the organic peroxide include dicumyl peroxide, 1,1-bis(t-butylperoxy)-3,3,5-trimethylcyclohexane, 2,5-dimethyl-2,5-di(t-butylperoxy)hexane, and di-t-butyl peroxide. Among them, dicumyl peroxide is preferably used. The amount of the crosslinking initiator is preferably 0.2 part by mass or more, more preferably 0.3 part by mass or more, and is preferably 3 parts by mass or less, more preferably 2 parts by mass or less, with respect to 100 parts by mass of the base rubber.

Further, the core rubber composition may further contain an organic sulfur compound. As the organic sulfur compound, diphenyl disulfides (e.g. diphenyl disulfide, bis (pentabromophenyl) persulfide), thiophenols, and thionaphthols (e.g. 2-thionaphthol) are preferably used. The amount of the organic sulfur compound is preferably 0.1 part by mass or more, more preferably 0.3 part by mass or more, and is preferably 5.0 parts by mass or less, more preferably 3.0 parts by mass or less, with respect to 100 parts by mass of the base rubber. In addition, the core rubber composition may further contain a carboxylic acid and/or a salt thereof. As the carboxylic acid and/or the salt thereof, a carboxylic acid having 1 to 30 carbon atoms and/or a salt thereof is preferred. As the carboxylic acid, an aliphatic carboxylic acid or an aromatic carboxylic acid (such as benzoic acid) can be used. The amount of the carboxylic acid and/or the salt thereof is preferably 1 part by mass or more and 40 parts by mass or less with respect to 100 parts by mass of the base rubber.

The intermediate layer and the cover are formed from a resin composition. The resin composition includes a thermoplastic resin as a resin component. Examples of the thermoplastic resin include an ionomer resin, a thermoplastic olefin copolymer, a thermoplastic polyamide, a thermoplastic polyurethane, a thermoplastic styrene resin, a thermoplastic polyester, a thermoplastic acrylic resin, a thermoplastic polyolefin, a thermoplastic polydiene, and a thermoplastic polyether. Among the thermoplastic resin, a thermoplastic elastomer having rubber elasticity is preferred. Examples of the thermoplastic elastomer include a thermoplastic polyurethane elastomer, a thermoplastic polyamide elastomer, a thermoplastic styrene elastomer, a thermoplastic polyester elastomer, and a thermoplastic acrylic elastomer.

(Ionomer Resin)

Examples of the ionomer resin include an ionomer resin consisting of a metal ion-neutralized product of a binary copolymer composed of an olefin and an α,β-unsaturated carboxylic acid having 3 to 8 carbon atoms (hereinafter, sometimes referred to as "binary ionomer resin".); an ionomer resin consisting of a metal ion-neutralized product of a ternary copolymer composed of an olefin, an α,β-unsaturated carboxylic acid having 3 to 8 carbon atoms, and an α,β-unsaturated carboxylic acid ester (hereinafter, sometimes referred to as "ternary ionomer resin".); and a mixture of these ionomer resins.

The olefin is preferably an olefin having 2 to 8 carbon atoms, and examples thereof include ethylene, propylene, butene, pentene, hexene, heptene, and octene. Among them, ethylene is preferred. Examples of the α,β-unsaturated carboxylic acid having 3 to 8 carbon atoms include acrylic acid, methacrylic acid, fumaric acid, maleic acid and crotonic acid. Among them, acrylic acid and methacrylic acid are preferred.

As the α,β-unsaturated carboxylic acid ester, an alkyl ester of an α,β-unsaturated carboxylic acid having 3 to 8 carbon atoms is preferred, an alkyl ester of acrylic acid, methacrylic acid, fumaric acid or maleic acid is more preferred, and an alkyl ester of acrylic acid or an alkyl ester of methacrylic acid is particularly preferred. Examples of the alkyl group constituting the ester include methyl ester, ethyl ester, propyl ester, n-butyl ester, and isobutyl ester.

As the binary ionomer resin, a metal ion-neutralized product of an ethylene-(meth)acrylic acid binary copolymer is preferred. As the ternary ionomer resin, a metal ion-neutralized product of a ternary copolymer composed of ethylene, (meth)acrylic acid and (meth)acrylic acid ester is preferred. Herein, (meth)acrylic acid means acrylic acid and/or methacrylic acid.

Examples of the metal ion for neutralizing at least a part of carboxyl groups of the binary ionomer resin and/or the ternary ionomer resin include a monovalent metal ion such as sodium, potassium and lithium; a divalent metal ion such as magnesium, calcium, zinc, barium and cadmium; a trivalent metal ion such as aluminum; and other metal ion such as tin and zirconium. The binary ionomer resin and the ternary ionomer resin are preferably neutralized with at least one metal ion selected from the group consisting of $Na^+$, $Mg^{2+}$, $Ca^{2+}$ and $Zn^{2+}$.

Examples of the binary ionomer resin include Himilan (registered trademark) 1555 (Na), 1557 (Zn), 1605 (Na), 1706 (Zn), 1707 (Na), AM7311 (Mg), AM7329 (Zn) and AM7337 (commercially available from Du Pont-Mitsui Polychemicals Co., Ltd.); Surlyn (registered trademark) 8945 (Na), 9945 (Zn), 8140 (Na), 8150 (Na), 9120 (Zn), 9150 (Zn), 6910 (Mg), 6120 (Mg), 7930 (Li), 7940 (Li) and AD8546 (Li) (commercially available from E.I. du Pont de Nemours and Company); and Iotek (registered trademark) 8000 (Na), 8030 (Na), 7010 (Zn), 7030 (Zn) (commercially available from ExxonMobil Chemical Corporation).

Examples of the ternary ionomer resin include Himilan AM7327 (Zn), 1855 (Zn), 1856 (Na) and AM7331 (Na) (commercially available from Du Pont-Mitsui Polychemicals Co., Ltd.); Surlyn 6320 (Mg), 8120 (Na), 8320 (Na), 9320 (Zn), 9320W (Zn), HPF1000 (Mg) and HPF2000 (Mg) (commercially available from E.I. du Pont de Nemours and Company); and Iotek 7510 (Zn) and 7520 (Zn) (commercially available from ExxonMobil Chemical Corporation).

(Thermoplastic Olefin Copolymer)

Examples of the thermoplastic olefin copolymer include a binary copolymer composed of an olefin and an α,β-unsaturated carboxylic acid having 3 to 8 carbon atoms (hereinafter, sometimes referred to as "binary copolymer".); a ternary copolymer composed of an olefin, an α,β-unsaturated carboxylic acid having 3 to 8 carbon atoms and an α,β-unsaturated carboxylic acid ester (hereinafter, sometimes referred to as "ternary copolymer".); and a mixture of these copolymers. The thermoplastic olefin copolymer is a nonionic copolymer having carboxyl groups not being neutralized.

Examples of the olefin include those olefins used for constituting the ionomer resin. In particular, ethylene is preferred. Examples of the α,β-unsaturated carboxylic acid having 3 to 8 carbon atoms and the ester thereof include those α,β-unsaturated carboxylic acids having 3 to 8 carbon atoms and the esters thereof used for constituting the ionomer resin.

As the binary copolymer, a binary copolymer composed of ethylene and (meth)acrylic acid is preferred. As the ternary copolymer, a ternary copolymer composed of ethylene, (meth)acrylic acid and (meth)acrylic acid ester is preferred.

Examples of the binary copolymer include Nucrel (registered trademark) N1050H, N2050H, N1110H and N0200H (commercially available from Du Pont-Mitsui Polychemicals Co., Ltd.); and Primacor (registered trademark) 59801 (commercially available from Dow Chemical Company). Examples of the ternary copolymer include Nucrel AN4318 and AN4319 (commercially available from Du Pont-Mitsui Polychemicals Co., Ltd.); and Primacor AT310 and AT320 (commercially available from Dow Chemical Company).

(Thermoplastic Polyamide and Thermoplastic Polyamide Elastomer)

The thermoplastic polyamide is not particularly limited as long as it is a thermoplastic resin having a plurality of amide bonds (—NH—CO—) in the main molecular chain thereof. Examples of the thermoplastic polyamide include a product having amide bonds within the molecule thereof, formed by a ring-opening polymerization of lactam or a reaction between a diamine component and a dicarboxylic acid component.

Examples of the thermoplastic polyamide include an aliphatic polyamide such as polyamide 6, polyamide 11, polyamide 12, polyamide 66, polyamide 610, polyamide 6T, polyamide 61, polyamide 9T, polyamide M5T and polyamide 612; and an aromatic polyamide such as poly-p-phenyleneterephthalamide and poly-m-phenyleneisophthalamide. These polyamides may be used solely or as a combination of at least two of them. Among them, the aliphatic polyamide such as polyamide 6, polyamide 66, polyamide 11 and polyamide 12 is preferred.

The polyamide elastomer has a hard segment part formed from a polyamide component, and a soft segment part. Examples of the component for forming the soft segment part of the polyamide elastomer include a polyether ester component and a polyether component. Examples of the polyamide elastomer include a polyether ester amide obtained by a reaction between a polyamide component (hard segment component) and a polyether ester component (soft segment component) formed from a polyoxyalkylene glycol and a dicarboxylic acid; and a polyether amide obtained by a reaction between a polyamide component (hard segment component) and a polyether component (soft segment component) formed from a dicarboxylic acid or diamine and a product obtained by aminizing or carboxylating both terminals of polyoxyalkylene glycol.

Examples of the thermoplastic polyamide include Rilsan (registered trademark) B BESN TL, BESN P20 TL, BESN P40 TL, MB3610, BMF O, BMN O, BMN O TLD, BMN BK TLD, BMN P20 D and BMN P40 D commercially available from Arkema Inc. Examples of the polyamide elastomer include PEBAX (registered trademark) 2533, 3533, 4033 and 5533 commercially available from Arkema Inc.

(Thermoplastic Styrene Elastomer)

As the thermoplastic styrene elastomer, a thermoplastic elastomer containing a styrene block is preferably used. The thermoplastic elastomer containing a styrene block includes a polystyrene block that is a hard segment, and a soft segment. The typical soft segment is a diene block. Examples of the constituent component of the diene block include butadiene, isoprene, 1,3-pentadiene and 2,3-dimethyl-1,3-butadiene. Among them, butadiene and isoprene are preferred. Two or more constituent components may be used in combination.

Examples of the thermoplastic elastomer containing a styrene block include a styrene-butadiene-styrene block copolymer (SBS), a styrene-isoprene-styrene block copolymer (SIS), a styrene-isoprene-butadiene-styrene block copolymer (SIBS), a hydrogenated product of SBS, a hydrogenated product of SIS and a hydrogenated product of SIBS. Examples of the hydrogenated product of SBS include a styrene-ethylene-butylene-styrene block copolymer (SEBS). Examples of the hydrogenated product of SIS include a styrene-ethylene-propylene-styrene block copolymer (SEPS). Examples of the hydrogenated product of SIBS include a styrene-ethylene-ethylene-propylene-styrene block copolymer (SEEPS).

The content of the styrene component in the thermoplastic elastomer containing a styrene block is preferably 10 mass % or more, more preferably 12 mass % or more, and particularly preferably 15 mass % or more. In light of the shot feeling of the obtained golf ball, the content is preferably 50 mass % or less, more preferably 47 mass % or less, and particularly preferably 45 mass % or less.

Examples of the thermoplastic elastomer containing a styrene block include an alloy of one kind or two or more kinds selected from the group consisting of SBS, SIS, SIBS, SEBS, SEPS, SEEPS and the hydrogenated products thereof with a polyolefin. It is estimated that the olefin component in the alloy contributes to the improvement in compatibility with the ionomer resin. By using the alloy, the resilience performance of the golf ball becomes high. An olefin having 2 to 10 carbon atoms is preferably used. Appropriate examples of the olefin include ethylene, propylene, butane and pentene. Ethylene and propylene are particularly preferred.

Specific examples of the polymer alloy include Rabalon (registered trademark) T3221C, T3339C, SJ4400N, SJ5400N, SJ6400N, SJ7400N, SJ8400N, SJ9400N, and SR04 (commercially available from Mitsubishi Chemical Corporation). Examples of the thermoplastic elastomer containing a styrene block include Epofriend A1010 (commercially available from Daicel Chemical Industries, Ltd.), and Septon HG-252 (commercially available from Kuraray Co., Ltd.).

(Thermoplastic Polyurethane and Thermoplastic Polyurethane Elastomer)

Examples of the thermoplastic polyurethane and the thermoplastic polyurethane elastomer include a thermoplastic resin and a thermoplastic elastomer, having a plurality of urethane bonds in the main molecular chain thereof. The polyurethane is preferably a product obtained by a reaction between a polyisocyanate component and a polyol component. Examples of the thermoplastic polyurethane elastomer include Elastollan (registered trademark) NY84A10, XNY85A, XNY90A, XNY97A, ET885 and ET890 (commercially available from BASF Japan Ltd.).

The resin composition may further include an additive, for example, a pigment component such as a white pigment (e.g. titanium oxide) and a blue pigment, a weight adjusting agent, a dispersant, an antioxidant, an ultraviolet absorber, a light stabilizer, a fluorescent material or a fluorescent brightener. Examples of the weight adjusting agent include an inorganic filler such as zinc oxide, barium sulfate, calcium carbonate, magnesium oxide, tungsten powder, and molybdenum powder.

The content of the white pigment (e.g. titanium oxide) is preferably 0.05 part by mass or more, more preferably 1 part by mass or more, and is preferably 10 parts by mass or less, more preferably 8 parts by mass or less, with respect to 100 parts by mass of the thermoplastic resin. If the content of the white pigment is 0.05 part by mass or more, it is possible to impart the opacity to the obtained golf ball constituent member. If the content of the white pigment is more than 10 parts by mass, the durability of the obtained golf ball constituent member may deteriorate.

The resin composition can be obtained, for example, by dry blending the thermoplastic resin and the additive. Further, the dry blended mixture may be extruded into a pellet form. Dry blending is preferably carried out by using for example, a mixer capable of blending raw materials in a pellet form, more preferably carried out by using a tumbler type mixer. Extruding can be carried out by using a publicly known extruder such as a single-screw extruder, a twin-screw extruder, and a twin-single screw extruder.

The resin composition used for the intermediate layer preferably includes an ionomer resin and a polyamide resin as a resin component, particularly preferably includes a binary ionomer resin and a polyamide resin as the resin component. If the intermediate layer material includes the ionomer resin and the polyamide resin, the stiffness of the intermediate layer is enhanced, thus the spin rate decrease effect becomes greater and the flight distance on driver shots becomes greater.

The total content of the ionomer resin and the polyamide resin in the resin component of the resin composition used for the intermediate layer is preferably 90 mass % or more, more preferably 94 mass % or more, and even more preferably 98 mass % or more.

The mass ratio (ionomer resin/polyamide resin) of the ionomer resin to the polyamide resin in the resin composition used for the intermediate layer preferably ranges from 90/10 to 50/50, more preferably ranges from 85/15 to 55/45, and even more preferably ranges from 80/20 to 60/40. If the mass ratio of the ionomer resin to the polyamide resin falls within the above range, the spin rate on driver shots is lowered due to the high bending elasticity, and the flight distance on driver shots becomes greater due to the good resilient elasticity.

The resin composition used for the cover preferably includes an ionomer resin as a resin component, particularly preferably includes a binary ionomer resin as the resin component. If the cover material includes an ionomer resin, the resilience of the cover is further enhanced, and thus the flight distance on driver shots becomes greater.

The content of the ionomer resin in the resin component of the resin composition used for the cover is preferably 70 mass % or more, more preferably 75 mass % or more, and even more preferably 80 mass % or more.

The reinforcing layer is formed from a reinforcing layer composition containing a resin component. A two-component curing type thermosetting resin is preferably used as the resin component. Specific examples of the two-component curing type thermosetting resin include an epoxy resin, a urethane resin, an acrylic resin, a polyester resin, and a cellulose resin. In light of the strength and the durability of the reinforcing layer, the two-component curing type epoxy resin and the two-component curing type urethane resin are preferred.

The reinforcing layer composition may further include an additive such as a coloring material (e.g. titanium dioxide), a phosphoric acid stabilizer, an antioxidant, a light stabilizer, a fluorescent brightener, an ultraviolet absorber, and an anti-blocking agent. The additive may be added into the base agent or the curing agent of the two-component curing type thermosetting resin.

[Production Method]

The molding conditions for heat-pressing the core rubber composition should be determined appropriately depending on the formulation of the rubber composition. Generally, it is preferred that the molding is carried out by heating the core rubber composition at a temperature ranging from 130° C. to 200° C. for 10 minutes to 60 minutes, alternatively, by molding the core rubber composition in a two-step heating, i.e. at a temperature ranging from 130° C. to 150° C. for 20 minutes to 40 minutes, and then at a temperature ranging from 160° C. to 180° C. for 5 minutes to 15 minutes.

The method for molding the intermediate layer is not limited, and examples thereof include a method of molding the resin composition into hemispherical half shells in advance, covering the core with two of the half shells, and performing compression molding; and a method of injection molding the resin composition directly onto the core to cover the core.

When injection molding the resin composition onto the core to mold the intermediate layer, it is preferred to use upper and lower molds having a hemispherical cavity. Injection molding of the intermediate layer can be carried out by protruding the hold pin to hold the spherical body to be covered, charging the heated and melted resin composition, and then cooling to obtain the intermediate layer.

When molding the intermediate layer by the compression molding method, the half shell can be molded by either the compression molding method or the injection molding method, but the compression molding method is preferred. Compression molding the resin composition into half shells can be carried out, for example, under a pressure of 1 MPa or more and 20 MPa or less at a molding temperature of −20° C. or more and 70° C. or less relative to the flow beginning temperature of the resin composition. By carrying out the molding under the above conditions, the half shells with a uniform thickness can be formed. Examples of the method for molding the intermediate layer with half shells include a method of covering the spherical body with two of the half shells and then performing compression molding. Compression molding the half shells into the intermediate layer can be carried out, for example, under a molding pressure of 0.5 MPa or more and 25 MPa or less at a molding temperature of −20° C. or more and 70° C. or less relative to the flow beginning temperature of the resin composition. By carrying out the molding under the above conditions, the intermediate layer with a uniform thickness can be formed.

The embodiment for molding the resin composition into the cover is not particularly limited, and examples thereof include an embodiment of injection molding the resin composition directly onto the intermediate layer; and an embodiment of molding the resin composition into hollow shells, covering the intermediate layer with a plurality of the hollow shells, and performing compression molding (preferably an embodiment of molding the resin composition into hollow half shells, covering the intermediate layer with two of the half shells, and performing compression molding). The golf ball body having the cover formed thereon is ejected from the mold, and as necessary, is preferably subjected to surface treatments such as deburring, cleaning and sandblast. Further, if desired, a mark may be formed thereon.

The total number of the dimples formed on the cover is preferably 200 or more and 500 or less. If the total number of the dimples is less than 200, the dimple effect is hardly obtained. On the other hand, if the total number of the dimples exceeds 500, the dimple effect is hardly obtained because the size of the respective dimples is small. The shape (shape in a plan view) of the formed dimples includes, for example, without limitation, a circle; a polygonal shape such as a roughly triangular shape, a roughly quadrangular shape, a roughly pentagonal shape, and a roughly hexagonal shape; and other irregular shape. The shape of the dimples may be employed solely, or two or more of the shapes may be employed in combination.

The paint film preferably has a thickness of, but not particularly limited to, 5 μm or more, more preferably 7 μm or more, and preferably has a thickness of 50 μm or less, more preferably 40 μm or less, and even more preferably 30 μm or less. If the thickness of the paint film is less than 5 μm, the paint film is easy to wear off due to continued use of the golf ball, and if the thickness of the paint film is more than 50 μm, the dimple effect is reduced, and thus the flight performance of the golf ball may deteriorate.

EXAMPLES

Hereinafter, the present invention will be described in detail by way of examples. However, the present invention is not limited to the examples described below, and various changes and modifications can be made without departing from the spirit and scope of the present invention.

[Evaluation Method]

(1) Core Hardness Distribution (Shore C Hardness)

The Shore C hardness measured on the surface of the spherical core (outer layer core), with a type P1 auto loading durometer commercially available from Kobunshi Keiki Co., Ltd., provided with a Shore C type spring hardness tester, was adopted as the surface hardness of the outer layer core. In addition, the core was cut into two hemispheres to obtain a cut plane, and the hardness was measured at the central point of the cut plane and at the point having a predetermined distance from the central point of the cut plane. It is noted that the hardness at four points having the predetermined distance from the central point were measured, and the hardness was determined by averaging the hardness at four points.

(2) Hardness of Intermediate Layer and Hardness of Cover

The hardness measured on the surface of the intermediate layer formed on the core was adopted as the surface hardness of the intermediate layer. The hardness measured on the surface (land part) of the cover formed on the intermediate layer was adopted as the surface hardness of the cover. The hardness was measured with a type P1 auto loading durometer commercially available from Kobunshi Keiki Co., Ltd., provided with a spring hardness tester. A Shore D type spring hardness tester or a Shore C type spring hardness tester was used as the spring hardness tester.

(3) Slab Hardness (Material Hardness)

Sheets with a thickness of about 2 mm were produced by injection molding the golf ball resin composition. These sheets were stored at 23° C. for two weeks. Three or more of these sheets were stacked on one another so as not to be affected by the measuring substrate on which the sheets were placed, and the hardness of the stack was measured with a type P1 auto loading durometer commercially available from Kobunshi Keiki Co., Ltd., provided with a spring hardness tester. A Shore D type spring hardness tester or a Shore C type spring hardness tester was used as the spring hardness tester.

(4) Bending Stiffness

A test piece with a thickness of about 2 mm, a width of 20 mm and a length of 100 mm was produced by injection molding the resin composition, and then stored at 23° C. for two weeks. The bending stiffness was measured according to JIS K 7106 (1995). The measurement was carried out under the conditions of temperature: 23° C., humidity: 50% RH, and a distance between the fulcrum and the measurement point: 50 mm.

(5) Compression Deformation Amount (mm)

The compression deformation amount of the golf ball or the spherical core along the compression direction (shrinking amount of the golf ball or the spherical core along the compression direction), when applying a load from 98 N as an initial load to 1275 N as a final load to the golf ball or the spherical core, was measured.

(6) Shot Feeling on Driver Shots

Thirty golfers were allowed to hit the golf ball with a driver (commercial name: "XXIO8", shaft hardness: R, loft angel: 10.5°, commercially available from Dunlop Sports Co. Limited) and to evaluate the shot feeling. The shot feeling was graded according to the following criterion, based on the number of the golfers who evaluated that the shot feeling was good.

E (excellent): 25 or more golfers
G (good): 20 to 24 golfers
F (fair): 15 to 19 golfers
P (poor): less than 15 golfers (7) Spin Rate, Ball Initial Velocity and Flight Distance on Driver Shots A driver (commercial name: "XXIO8", shaft hardness: R, loft angel: 10.5°, commercially available from Dunlop Sports Co. Limited) was installed on a swing robot M/C commercially available from Golf Laboratories, Inc. The golf ball was hit at a head speed of 40 m/sec, and the ball initial velocity (m/s) and the spin rate (rpm) right after hitting the golf ball, and the flight distance (the distance (yd) from the launch point to the stop point) were measured. This measurement was conducted twelve times for each golf ball, and the average value thereof was adopted as the measurement value for the golf ball. A sequence of photographs of the hit golf ball were taken for measuring the spin rate right after hitting the golf ball.

[Production of Golf Ball]

(1) Production of Spherical Core

Spherical Cores No. a to f and h to l

According to the formulations shown in Table 1, the materials were kneaded with a kneading roll to prepare the rubber compositions. The rubber compositions shown in Table 2 were heat-pressed at 170° C. for 25 minutes in upper and lower molds having a hemispherical cavity to produce the inner layer core. Then, the rubber compositions shown in Table 2 were molded into half shells. Two of the half shells were used to cover the inner layer core. The inner layer core and the half shells were heat-pressed together at a temperature ranging from 140° C. to 170° C. for 25 minutes in upper and lower molds having a hemispherical cavity to produce the spherical core. It is noted that the amount of barium sulfate in Table 1 was adjusted such that the density of the inner layer is identical to the density of the outer layer.

Spherical Core No. g

According to the formulations shown in Table 1, the materials were kneaded with a kneading roll to prepare the rubber compositions. The rubber compositions shown in Table 2 were heat-pressed at a temperature ranging from 150° C. to 170° C. for 25 minutes in upper and lower molds having a hemispherical cavity to produce the single-layered cores. It is noted that the amount of barium sulfate in Table 1 was adjusted such that the golf ball has a mass in a range from 45.00 g to 45.92 g.

TABLE 1

| Rubber composition No. | | 1 | 2 | 3 | 4 | 5 | 6 | 7 | 8 | 9 | 10 | 11 | 12 | 13 |
|---|---|---|---|---|---|---|---|---|---|---|---|---|---|---|
| Formulation (parts by mass) | Polybutadiene rubber | 100 | 100 | 100 | 100 | 100 | 100 | 100 | 100 | 100 | 100 | 100 | 100 | 100 |
| | Magnesium oxide | — | — | — | — | — | — | — | 34.8 | — | — | — | — | — |
| | Methacrylic acid | — | — | — | — | — | — | — | 28 | — | — | — | — | — |
| | Zinc acrylate | 20 | 25 | 44 | 38 | 46.5 | 25 | 32.5 | — | 35 | 35 | 26 | 28 | 13 |
| | Zinc oxide | 12 | 5 | 5 | 5 | 5 | 5 | 5 | — | 5 | 12 | 5 | 5 | 12 |
| | Barium sulfate | *) | *) | *) | *) | *) | *) | *) | — | *) | *) | *) | *) | *) |
| | Dicumyl peroxide | 0.9 | 0.7 | 0.7 | 0.7 | 0.7 | 0.7 | 0.9 | 0.9 | 0.9 | 0.9 | 0.7 | 0.7 | 0.9 |
| | PBDS | — | — | — | — | — | — | 0.3 | — | 0.3 | — | — | — | — |
| | DPDS | — | 0.5 | 0.5 | 0.5 | 0.5 | 0.5 | — | — | — | — | 0.5 | 0.5 | — |
| | 2-Thionaphtol | 0.1 | — | — | — | — | — | — | — | — | 0.1 | — | — | 0.1 |
| | Benzoic acid | 2 | — | — | — | — | — | — | — | — | 2 | — | — | 2 |
| | Antioxidant | — | — | 0.1 | — | 0.1 | 0.1 | — | — | — | — | 0.1 | 0.1 | — |

*) Appropriate amount

Polybutadiene rubber: "BR730 (cis-bond content: 96 mass %)" commercially available from JSR Corporation Magnesium oxide: "MAGSARAT (registered trademark) 150ST" commercially available from Kyowa Chemical Industry Co., Ltd.

Methacrylic acid: commercially available from Mitsubishi Rayon Co., Ltd.

Zinc acrylate: "Sanceler (registered trademark) SR" commercially available from Sanshin Chemical Industry Co., Ltd.

Zinc oxide: "Ginrei (registered trademark) R" commercially available from Toho Zinc Co., Ltd.

Barium sulfate: "Barium Sulfate BD" commercially available from Sakai Chemical Industry Co., Ltd.

Dicumyl peroxide: "Percumyl (registered trademark) D" commercially available from NOF Corporation PBDS (bis(pentabromophenyl) persulfide): commercially available from Kawaguchi Chemical Industry Co., Ltd.

DPDS (diphenyldisulfide): commercially available from Sumitomo Seika Chemicals Co., Ltd.

2-Thionaphtol: commercially available from Zhejiang shou & Fu Chemical Co., Ltd.

Benzoic acid: commercially available from Emerald Kalama Chemical Co., Ltd.

Antioxidant (dibutylhydroxytoluene): "H-BHT" commercially available from Honshu Chemical Industry Co. Ltd.

TABLE 2

| Spherical core No. | | a | b | c | d | e | f | g | h | i | j | k | l |
|---|---|---|---|---|---|---|---|---|---|---|---|---|---|
| Inner layer | Rubber composition No. | 1 | 1 | 1 | 2 | 6 | 1 | 7 | 8 | 11 | 13 | 1 | 1 |
| | Radius X (mm) | 12.0 | 12.0 | 12.0 | 12.0 | 12.0 | 12.0 | 19.4 | 7.5 | 12.0 | 12.0 | 12.0 | 12.0 |
| | Cross-sectional area S1 ($mm^2$) | 452 | 452 | 452 | 452 | 452 | 452 | 1,176 | 177 | 452 | 452 | 452 | 452 |
| | Volume V1 ($mm^3$) | 7,238 | 7,238 | 7,238 | 7,238 | 7,238 | 7,238 | 30,348 | 1,767 | 7,238 | 7,238 | 7,238 | 7,238 |
| Outer layer | Rubber composition No. | 3 | 4 | 5 | 3 | 3 | 10 | — | 9 | 3 | 12 | 12 | 4 |
| | Thickness Y (mm) | 7.5 | 7.2 | 7.4 | 7.4 | 7.5 | 7.5 | — | 11.9 | 7.5 | 7.5 | 7.4 | 7.5 |
| | Cross-sectional area S2 ($mm^2$) | 742 | 706 | 724 | 724 | 742 | 742 | — | 1,000 | 742 | 742 | 724 | 742 |
| | Volume V2 ($mm^3$) | 23,821 | 22,410 | 23,110 | 23,110 | 23,821 | 23,821 | — | 28,581 | 23,821 | 23,821 | 23,110 | 23,821 |
| | Y/X | 0.63 | 0.60 | 0.61 | 0.61 | 0.63 | 0.63 | — | 1.58 | 0.63 | 0.63 | 0.61 | 0.63 |
| | S2/S1 | 1.64 | 1.56 | 1.60 | 1.60 | 1.64 | 1.64 | — | 5.66 | 1.64 | 1.64 | 1.60 | 1.64 |
| | V2V1 | 3.29 | 3.10 | 3.19 | 3.19 | 3.29 | 3.29 | — | 16.17 | 3.29 | 3.29 | 3.19 | 3.29 |
| Hardness (Shore C) | Ho | 63 | 63 | 63 | 60 | 70 | 63 | 54 | 62 | 72 | 52 | 63 | 63 |
| | $H_{X-1}$ | 74 | 74 | 74 | 74 | 70 | 74 | — | 65 | 70 | 63 | 74 | 74 |
| | $H_{X+1}$ | 85 | 84 | 86 | 85 | 85 | 76 | — | 71 | 85 | 68 | 68 | 84 |
| | $H_{X+Y}$ | 85 | 86 | 84 | 85 | 85 | 85 | 80 | 85 | 85 | 68 | 68 | 86 |
| | $H_{X-1}$ − Ho | 11 | 11 | 11 | 14 | 0 | 11 | — | 3 | −2 | 11 | 11 | 11 |
| | $H_{X+1}$ − $H_{X-1}$ | 11 | 10 | 12 | 11 | 15 | 2 | — | 6 | 15 | 5 | −6 | 10 |
| | $H_{X+Y}$ − $H_{X+1}$ | 0 | 2 | −2 | 0 | 0 | 9 | — | 14 | 0 | 0 | 0 | 2 |
| | $H_{X+Y}$ − Ho | 22 | 23 | 21 | 25 | 15 | 22 | 26 | 23 | 13 | 16 | 5 | 23 |
| Angle (°) | α | 45.0 | 45.0 | 45.0 | 51.8 | 0.0 | 45.0 | — | 24.8 | −10.3 | 45.0 | 45.0 | 45.0 |
| | β | 0.0 | 17.9 | −17.5 | 0.0 | 0.0 | 54.2 | — | 52.2 | 0.0 | 0.0 | 0.0 | 17.1 |
| | α − β | 45.0 | 27.1 | 62.5 | 51.8 | 0.0 | −9.2 | — | −27.4 | −10.3 | 45.0 | 45.0 | 27.9 |
| Diameter (mm) | | 39.0 | 38.4 | 38.7 | 38.7 | 39.0 | 39.0 | 38.7 | 38.7 | 39.0 | 39.0 | 38.7 | 39.0 |
| Compression deformation amount (mm) | | 2.6 | 2.6 | 2.6 | 2.6 | 2.6 | 2.6 | 2.8 | 2.8 | 2.8 | 3.2 | 3.2 | 2.6 |

(2) Preparation of Resin Composition

According to the formulations shown in Table 3, the materials were mixed with a twin-screw kneading extruder to prepare the resin composition in a pellet form. The extruding conditions were a screw diameter of 45 mm, a screw rotational speed of 200 rpm, and a screw L/D=35, and the mixture was heated to 160° C. to 230° C. at the die position of the extruder.

TABLE 3

| Resin composition No. | | A | B | C | D | E |
|---|---|---|---|---|---|---|
| Formulation (parts by mass) | Polyamide 6 | 35 | — | — | — | — |
| | Surlyn 8150 | 32.5 | 25 | — | — | — |
| | Surlyn 9150 | 32.5 | — | — | — | — |
| | Himilan 1555 | — | — | — | 10 | — |
| | Himilan 1605 | — | 25 | 47 | — | — |
| | Himilan AM7329 | — | 50 | 50 | 55 | 40 |
| | Himilan AM7337 | — | — | — | 5 | 43 |
| | Rabalon T3221C | — | — | 3 | — | 17 |
| | Nucrel N1050H | — | — | — | 30 | — |
| | Barium sulfate | *) | *) | *) | *) | *) |
| | Titanium dioxide | 4 | 4 | 4 | 3 | 6 |
| Bending stiffness ($kgf/cm^2$) | | 7000 | 3600 | 2700 | 2100 | 1400 |
| Material hardness (Shore C) | | 96 | 92 | 91 | 90 | 84 |
| Material hardness (Shore D) | | 72 | 66 | 63 | 61 | 55 |

*) Appropriate amount

The raw materials used in Table 3 are as follows.

Polyamide 6: "CM1017K" commercially available from Toray Industries, Inc.

Surlyn (registered trademark) 8150: sodium ion-neutralized ethylene-methacrylic acid copolymer ionomer resin commercially available from E. I. du Pont de Nemours and Company Surlyn 9150: zinc ion-neutralized ethylene-methacrylic acid copolymer ionomer resin commercially available from E. I. du Pont de Nemours and Company Himilan (registered trademark) 1555: sodium ion-neutralized ethylene-methacrylic acid copolymer ionomer resin commercially available from Du Pont-Mitsui Polychemicals Co., Ltd.

Himilan 1605: sodium ion-neutralized ethylene-methacrylic acid copolymer ionomer resin commercially available from Du Pont-Mitsui Polychemicals Co., Ltd.

Himilan AM7329: zinc ion-neutralized ethylene-methacrylic acid copolymer ionomer resin commercially available from Du Pont-Mitsui Polychemicals Co., Ltd.

Himilan AM7337: sodium ion-neutralized ethylene-methacrylic acid copolymer ionomer resin commercially available from Du Pont-Mitsui Polychemicals Co., Ltd.

Rabalon (registered trademark) T3221C: thermoplastic styrene elastomer commercially available from Mitsubishi Chemical Corporation Nucrel (registered trademark) N1050H: ethylene-methacrylic acid copolymer commercially available from Du Pont-Mitsui Polychemicals Co., Ltd.

Barium sulfate: "Barium Sulfate BD" commercially available from Sakai Chemical Industry Co., Ltd.

(3) Production of Intermediate Layer

The resin compositions shown in Tables 4 to 6 were injection molded on the core obtained above to form the intermediate layer. It is noted that the amount of barium sulfate in Table 3 was adjusted such that the slab hardness became the desired value.

(4) Production of Cover

The resin compositions shown in Tables 4 to 6 were injection molded on the intermediate layer-covered spherical body obtained above to form the cover. It is noted that the amount of barium sulfate in Table 3 was adjusted such that the slab hardness became the desired value. A plurality of dimples were formed on the cover.

The surfaces of the obtained golf ball bodies were treated with sandblast and marked. Then, the clear paint was applied on the surfaces of the golf ball bodies and dried in an oven to obtain the golf balls. The evaluation results of the obtained golf balls are shown in Tables 4 to 6.

TABLE 4

| Golf ball No. | | | 1 | 2 | 3 | 4 | 5 | 6 | 7 | 8 |
|---|---|---|---|---|---|---|---|---|---|---|
| Spherical core No. | | | a | b | c | d | e | a | c | l |
| Inner layer | Radius X (mm) | | 12.0 | 12.0 | 12.0 | 12.0 | 12.0 | 12.0 | 12.0 | 12.0 |
| | Cross-sectional area S1 ($mm^2$) | | 452 | 452 | 452 | 452 | 452 | 452 | 452 | 452 |
| | Volume V1 ($mm^3$) | | 7,238 | 7,238 | 7,238 | 7,238 | 7,238 | 7,238 | 7,238 | 7,238 |
| Outer layer | Thickness Y(mm) | | 7.5 | 7.2 | 7.4 | 7.4 | 7.5 | 7.5 | 7.4 | 7.5 |
| | Cross-sectional area S2 ($mm^2$) | | 742 | 706 | 724 | 724 | 742 | 742 | 724 | 742 |
| | Volume V2 ($mm^3$) | | 23,821 | 22,410 | 23,110 | 23,110 | 23,821 | 23,821 | 23,110 | 23,821 |
| | Y/X | | 0.63 | 0.60 | 0.61 | 0.61 | 0.63 | 0.63 | 0.61 | 0.63 |
| | S2/S1 | | 1.64 | 1.56 | 1.60 | 1.60 | 1.64 | 1.64 | 1.60 | 1.64 |
| | V2/V1 | | 3.29 | 3.10 | 3.19 | 3.19 | 3.29 | 3.29 | 3.19 | 3.29 |
| Hardness (JIS-C) | Ho | | 63 | 63 | 63 | 60 | 70 | 63 | 63 | 63 |
| | $H_{X+Y}$ | | 85 | 86 | 84 | 85 | 85 | 85 | 84 | 86 |
| | $H_{X+1} - H_{X-1}$ | | 11 | 10 | 12 | 11 | 15 | 11 | 12 | 10 |
| | $H_{X+Y} - Ho$ | | 22 | 23 | 21 | 25 | 15 | 22 | 21 | 23 |
| Angel (°) | α | | 45.0 | 45.0 | 45.0 | 51.8 | 0.0 | 45.0 | 45.0 | 45.0 |
| | β | | 0.0 | 17.9 | −17.5 | 0.0 | 0.0 | 0.0 | −17.5 | 17.1 |
| | α − β | | 45.0 | 27.1 | 62.5 | 51.8 | 0.0 | 45.0 | 62.5 | 27.9 |
| Diameter of dual-layered core (mm) | | | 39.0 | 38.4 | 38.7 | 38.7 | 39.0 | 39.0 | 38.7 | 39.0 |
| Compression deformation amount (mm) | | | 2.6 | 2.6 | 2.6 | 2.6 | 2.6 | 2.6 | 2.6 | 2.6 |
| Intermediate layer | Material | Resin composition No. | A | A | A | A | A | A | A | A |
| | | Material hardness (Shore D) | 72 | 72 | 72 | 72 | 72 | 72 | 72 | 72 |
| | Surface hardness HmsC (Shore C) | | 97 | 97 | 97 | 97 | 97 | 97 | 97 | 97 |
| | Surface hardness HmsD (Shore D) | | 73 | 73 | 73 | 73 | 73 | 73 | 73 | 73 |
| | HmsC − HmsD | | 24 | 24 | 24 | 24 | 24 | 24 | 24 | 24 |
| | Thickness Tm (mm) | | 1.0 | 1.3 | 0.8 | 1.0 | 1.0 | 1.0 | 0.8 | 1.0 |
| Cover | Material | Resin composition No. | C | D | C | C | C | D | B | C |
| | | Material hardness (Shore D) | 63 | 61 | 63 | 63 | 63 | 61 | 66 | 63 |
| | Surface hardness HcsC (Shore C) | | 93 | 92 | 93 | 93 | 93 | 92 | 94 | 93 |
| | Surface hardness HcsD (Shore D) | | 65 | 63 | 65 | 65 | 65 | 63 | 68 | 65 |
| | HcsC − HcsD | | 28 | 29 | 28 | 28 | 28 | 29 | 26 | 28 |
| | Thickness Tc (mm) | | 0.85 | 0.85 | 1.2 | 1.0 | 0.85 | 0.85 | 1.2 | 0.85 |
| Hardness difference (Hm − Hc) (Shore D) | | | 9 | 11 | 9 | 9 | 9 | 11 | 6 | 9 |
| Hardness difference (Hm − $H_{X+1}$) (Shore C) | | | 11 | 10 | 12 | 11 | 11 | 11 | 10 | 12 |
| Hardness difference (Hc − $H_{X+1}$) (Shore C) | | | 6 | 4 | 7 | 6 | 6 | 5 | 6 | 7 |
| Ratio (Sm/Sc) | | | 2.6 | 3.3 | 2.6 | 2.6 | 2.6 | 3.3 | 1.9 | 2.6 |
| Evaluation | Compression deformation amount (mm) | | 2.0 | 1.9 | 2.0 | 1.9 | 2.0 | 2.0 | 1.9 | 2.0 |
| | On driver shots | Shot feeling | G | G | G | G | G | G | G | G |
| | | Initial velocity (m/s) | 59.0 | 58.8 | 59.1 | 58.7 | 59.3 | 59.0 | 59.1 | 59.1 |
| | | Spin rate (rpm) | 2,400 | 2,350 | 2,500 | 2,300 | 2,650 | 2,450 | 2,450 | 2,500 |
| | | Flight distance (yd) | 230.0 | 229.5 | 229.5 | 229.5 | 229.0 | 229.5 | 230.0 | 229.5 |

TABLE 5

| Golf ball No. | | | 9 | 10 | 11 | 12 | 13 | 14 |
|---|---|---|---|---|---|---|---|---|
| Spherical core No. | | | f | g | h | i | j | k |
| Inner layer | Radius X (mm) | | 12.0 | 19.4 | 7.5 | 12.0 | 12.0 | 12.0 |
| | Cross-sectional area S1 ($mm^2$) | | 452 | — | 177 | 452 | 452 | 452 |
| | Volume V1 ($mm^3$) | | 7,238 | — | 1,767 | 7,238 | 7,238 | 7,238 |
| Outer layer | Thickness Y(mm) | | 7.5 | — | 11.9 | 7.5 | 7.5 | 7.4 |
| | Cross-sectional area S2 ($mm^2$) | | 742 | — | 1,000 | 742 | 742 | 724 |
| | Volume V2 ($mm^3$) | | 23,821 | — | 28,581 | 23,821 | 23,821 | 23,110 |
| | Y/X | | 0.63 | — | 1.58 | 0.63 | 0.63 | 0.61 |
| | S2/S1 | | 1.64 | — | 5.66 | 1.64 | 1.64 | 1.60 |
| | V2/V1 | | 3.29 | — | 16.17 | 3.29 | 3.29 | 3.19 |
| Hardness (JIS-C) | Ho | | 63 | 54 | 62 | 72 | 52 | 63 |
| | $H_{X+Y}$ | | 85 | 80 | 85 | 85 | 68 | 68 |
| | $H_{X+1} - H_{X-1}$ | | 2 | — | 6 | 15 | 5 | −6 |
| | $H_{X+Y} - Ho$ | | 22 | 26 | 23 | 13 | 16 | 5 |
| Angel (°) | α | | 45.0 | — | 24.8 | −10.3 | 45.0 | 45.0 |
| | β | | 54.2 | — | 52.2 | 0.0 | 0.0 | 0.0 |
| | α − β | | −9.2 | — | −27.4 | −10.3 | 45.0 | 45.0 |
| Diameter of dual-layered core (mm) | | | 39.0 | 38.7 | 38.7 | 39.0 | 39.0 | 38.7 |
| Compression deformation amount (mm) | | | 2.6 | 2.8 | 2.8 | 2.8 | 3.2 | 3.2 |
| Intermediate layer | Material | Resin composition No. | A | A | A | A | A | A |
| | | Material hardness (Shore D) | 72 | 72 | 72 | 72 | 72 | 72 |
| | Surface hardness HmsC (Shore C) | | 97 | 97 | 97 | 97 | 97 | 97 |
| | Surface hardness HmsD (Shore D) | | 73 | 73 | 73 | 73 | 73 | 73 |
| | HmsC − HmsD | | 24 | 24 | 24 | 24 | 24 | 24 |
| | Thickness Tm (mm) | | 1.0 | 0.8 | 1.0 | 1.0 | 1.0 | 0.8 |

TABLE 5-continued

| Golf ball No. | | | 9 | 10 | 11 | 12 | 13 | 14 |
|---|---|---|---|---|---|---|---|---|
| Cover | Material | Resin composition No. | D | B | C | C | D | B |
| | | Material hardness (Shore D) | 61 | 66 | 63 | 63 | 61 | 66 |
| | Surface hardness HcsC (Shore C) | | 92 | 94 | 93 | 93 | 92 | 94 |
| | Surface hardness HcsD (Shore D) | | 63 | 68 | 65 | 65 | 63 | 68 |
| | HcsC − HcsD | | 29 | 26 | 28 | 28 | 29 | 26 |
| | Thickness Tc (mm) | | 0.85 | 1.2 | 1.0 | 0.85 | 0.85 | 1.2 |
| Hardness difference (Hm − Hc) (Shore D) | | | 11 | 6 | 9 | 9 | 11 | 6 |
| Hardness difference (Hm − $H_{X+1}$) (Shore C) | | | 11 | 16 | 11 | 11 | 28 | 28 |
| Hardness difference (Hc − $H_{X+1}$) (Shore C) | | | 5 | 12 | 6 | 6 | 22 | 24 |
| Ratio (Sm/Sc) | | | 3.3 | 1.9 | 2.6 | 2.6 | 3.3 | 1.9 |
| Evaluation | Compression deformation amount (mm) | | 2.0 | 2.1 | 2.0 | 2.1 | 2.3 | 2.4 |
| | On driver shots | Shot feeling | G | G | G | G | G | G |
| | | Initial velocity (m/s) | 58.3 | 58.7 | 58.5 | 59.2 | 58.0 | 58.1 |
| | | Spin rate (rpm) | 2,250 | 2,550 | 2,350 | 2,800 | 2,150 | 2,200 |
| | | Flight distance (yd) | 228.0 | 227.0 | 228.0 | 227.0 | 227.5 | 227.5 |

TABLE 6

| Golf ball No. | | | 15 | 16 | 17 | 18 |
|---|---|---|---|---|---|---|
| | Spherical core No. | | I | d | I | d |
| | Inner layer | Radius X (mm) | 12.0 | 12.0 | 12.0 | 12.0 |
| | | Cross-sectional area S1 ($mm^2$) | 452 | 452 | 452 | 452 |
| | | Volume V1 ($mm^3$) | 7,238 | 7,238 | 7,238 | 7,238 |
| | Outer layer | Thickness Y (mm) | 7.5 | 7.4 | 7.5 | 7.4 |
| | | Cross-sectional area S2 ($mm^2$) | 742 | 724 | 742 | 724 |
| | | Volume V2 ($mm^3$) | 23,821 | 23,110 | 23,821 | 23,110 |
| | | Y/X | 0.63 | 0.61 | 0.63 | 0.61 |
| | | S2/S1 | 1.64 | 1.60 | 1.64 | 1.60 |
| | | V2/V1 | 3.29 | 3.19 | 3.29 | 3.19 |
| | Hardness (JIS-C) | Ho | 63 | 60 | 63 | 60 |
| | | $H_{X+Y}$ | 86 | 85 | 86 | 85 |
| | | $H_{X+1}$-$H_{X-1}$ | 10 | 11 | 10 | 11 |
| | | $H_{X+Y}$-Ho | 23 | 25 | 23 | 25 |
| | Angel (°) | α | 45.0 | 51.8 | 45.0 | 51.8 |
| | | β | 17.1 | 0.0 | 17.1 | 0.0 |
| | | α-β | 27.9 | 51.8 | 27.9 | 51.8 |
| | Diameter of dual-layered core (mm) | | 39.0 | 38.7 | 39.0 | 38.7 |
| | Compression deformation amount (mm) | | 2.6 | 2.6 | 2.6 | 2.6 |
| Intermediate layer | Material | Resin composition No. | C | B | E | B |
| | | Material hardness (Shore D) | 63 | 66 | 55 | 66 |
| | Surface hardness HmsC (Shore C) | | 93 | 94 | 91 | 94 |
| | Surface hardness HmsD (Shore D) | | 65 | 68 | 62 | 68 |
| | HmsC-HmsD | | 28 | 26 | 29 | 26 |
| | Thickness Tm (mm) | | 1.0 | 1.0 | 1.0 | 1.0 |
| Cover | Material | Resin composition No. | D | A | D | E |
| | | Material hardness (Shore D) | 61 | 72 | 61 | 55 |
| | Surface hardness HcsC (Shore C) | | 92 | 97 | 92 | 91 |
| | Surface hardness HcsD (Shore D) | | 63 | 73 | 63 | 62 |
| | HcsC-HcsD | | 29 | 24 | 29 | 29 |
| | Thickness Tc (mm) | | 0.85 | 1.0 | 0.85 | 1.0 |
| Hardness difference (Hm-Hc) (Shore D) | | | 2 | −6 | −6 | 11 |
| Hardness difference(Hm-$H_{X+1}$) (Shore C) | | | 5 | 7 | −2 | 7 |
| Hardness difference (Hc-$H_{X+1}$) (Shore C) | | | 4 | 11 | 4 | −1 |
| Ratio (Sm/Sc) | | | 1.3 | 0.5 | 0.7 | 2.6 |
| Evaluation | Compression deformation amount (mm) | | 2.1 | 2.0 | 2.2 | 2.2 |
| | On driver shots | Shot feeling | G | P | E | E |
| | | Initial velocity (m/s) | 58.7 | 59.1 | 58.3 | 58.4 |
| | | Spin rate (rpm) | 2,450 | 2,350 | 2,550 | 2,600 |
| | | Flight distance (yd) | 228.0 | 231.0 | 225.0 | 225.0 |

Golf balls having the same formulation and thickness in the intermediate layer and in the cover, are compared. Golf ball No. 11 is the case where the difference (α−β) between the angle α of the hardness gradient of the inner layer and the angle β of the hardness gradient of the outer layer is less than 0°. Golf ball No. 11 travels a shorter distance than Golf ball No. 4. Golf ball No. 12 is the case where the angle α of the hardness gradient of the inner layer is less than 0°. Golf ball No. 12 travels a shorter distance than Golf ball No. 1. Golf ball No. 9 is the case where the difference (α−β)

between the angle α of the hardness gradient of the inner layer and the angle β of the hardness gradient of the outer layer is less than 0°. Golf ball No. 13 is the case where the surface hardness ($H_{X+Y}$) is 70 or less in Shore C hardness. Golf balls No. 9 and 13 travel a shorter distance than Golf ball No. 6. Golf ball No. 10 is the case where the spherical core is single-layered. Golf ball No. 14 is the case where the difference ($H_{X+1}-H_{X-1}$) is less than 0 in Shore C hardness. Golf balls No. 10 and 14 travel a shorter distance than Golf ball No. 7.

In addition, Golf balls comprising the same spherical core are compared. Golf balls No. 15 and 17 are the cases where the hardness (Hm) of the intermediate layer is less than 65. Golf balls No. 15 and 17 travel a shorter distance than Golf ball No. 8. Golf ball No. 4 is the case where the difference (Hm−Hc) exceeds 0. Golf ball No. 4 exhibits a better shot feeling than Golf ball No. 16.

This application is based on Japanese Patent Application No. 2015-090790 filed on Apr. 27, 2015, the contents of which are hereby incorporated by reference.

The invention claimed is:

1. A golf ball comprising a spherical core, an intermediate layer positioned outside the spherical core, and a cover positioned outside the intermediate layer, wherein:

the spherical core includes an inner layer and an outer layer, a difference ($H_{X+1}-H_{X-1}$) between a hardness ($H_{X+1}$) at a point outwardly away in a radial direction from a boundary between the inner layer and the outer layer of the spherical core by 1 mm and a hardness ($H_{X-1}$) at a point inwardly away in the radial direction from the boundary between the inner layer and the outer layer of the spherical core by 1 mm is 0 or more in Shore C hardness, a surface hardness ($H_{X+Y}$) of the spherical core is more than 70 in Shore C hardness, an angle α of a hardness gradient of the inner layer calculated by a formula (1) is 0° or more, a difference (α−β) between the angle α and an angle β of a hardness gradient of the outer layer calculated by a formula (2) is 0° or more, the intermediate layer has a material hardness (Hm) ranging from 65 to 80 in Shore D hardness, the cover has a material hardness (Hc) ranging from 57 to 72 in Shore D hardness, the intermediate layer has a highest hardness among the constituent members of the golf ball, a diameter of the spherical core ranges from 36.5 mm to 42.0 mm, and a ratio (Y/X) of the thickness Y (mm) of the outer layer to the radius X (mm) of the inner layer ranges from 0.2 to 0.63, $$\alpha=(180/\pi)\times a\tan[\{H_{x-1}-Ho\}/(X-1)] \quad (1)$$

$$\beta=(180/\pi)\times a\tan[\{H_{X+Y}-H_{x+1}\}/(Y-1)] \quad (2)$$

wherein X represents a radius (mm) of the inner layer, Y represents a thickness (mm) of the outer layer, Ho represents a center hardness (Shore C) of the spherical core, $H_{X-1}$ represents the hardness (Shore C) at the point inwardly away in the radial direction from the boundary between the inner layer and the outer layer of the spherical core by 1 mm, $H_{X+1}$ represents the hardness (Shore C) at the point outwardly away in the radial direction from the boundary between the inner layer and the outer layer of the spherical core by 1 mm, and $H_{X+Y}$ represents the surface hardness (Shore C) of the spherical core.

2. The golf ball according to claim 1, wherein a hardness difference (Hm−Hc) between a material hardness (Hc) of the cover and the material hardness (Hm) of the intermediate layer is more than 0 in Shore D hardness.

3. The golf ball according to claim 1, wherein the center hardness (Ho) of the spherical core is less than 60 in Shore C hardness.

4. The golf ball according to claim 1, wherein the angle β ranges from −20° to +20°.

5. The golf ball according to claim 1, wherein a ratio (S2/S1) of a cross-sectional area S2 ($mm^2$) of the outer layer to a cross-sectional area S1 ($mm^2$) of the inner layer on a cut plane of the spherical core obtained by cutting the spherical core into two hemispheres ranges from 0.5 to 6.0.

6. The golf ball according to claim 1, wherein a ratio (V2/V1) of a volume V2 ($mm^3$) of the outer layer to a volume V1 ($mm^3$) of the inner layer ranges from 1.0 to 20.0.

7. The golf ball according to claim 1, wherein a ratio (Sm/Sc) of a bending stiffness (Sm) of a resin composition for forming the intermediate layer to a bending stiffness (Sc) of a resin composition for forming the cover is 2 or more.

8. The golf ball according to claim 1, wherein a resin composition for forming the intermediate layer includes a polyamide resin and an ionomer resin as a resin component, and the intermediate layer has a thickness (Tm) ranging from 0.7 mm to 1.5 mm.

9. The golf ball according to claim 1, wherein a resin composition for forming the cover includes an ionomer resin as a resin component, and the cover has a thickness (Tc) ranging from 0.5 mm to 1.3 mm.

10. The golf ball according to claim 8, wherein a mass ratio (ionomer resin/polyamide resin) of the ionomer resin to the polyamide resin ranges from 90/10 to 50/50.

11. The golf ball according to claim 1, wherein the intermediate layer has a surface hardness (HmsC) ranging from 93 to 100 in Shore C hardness.

12. The golf ball according to claim 1, wherein the intermediate layer has a surface hardness (HmsD) ranging from 66 to 80 in Shore D hardness.

13. The golf ball according to claim 1, wherein a resin composition for forming the intermediate layer has a bending stiffness (Sm) ranging from 3000 kgf/$cm^2$ to 9000 kgf/cm.

14. The golf ball according to claim 1, wherein the cover has a surface hardness (HcsC) ranging from 91 to 98 in Shore C hardness.

15. The golf ball according to claim 1, wherein the cover has a surface hardness (HcsD) ranging from 58 to 72 in Shore D hardness.

16. The golf ball according to claim 1, wherein a resin composition for forming the cover has a bending stiffness (Sc) ranging from 1500 kgf/$cm^2$ to 6000 kgf/$cm^2$.

17. The golf ball according to claim 1, wherein the radius X ranges from 9 mm to 16 mm, and a hardness difference ($H_{X+Y}-H_{X+1}$) between the hardness $H_{X+1}$ and the surface hardness $H_{X+Y}$ ranges from −7 to 7 in Shore C hardness.

18. The golf ball according to claim 1, wherein:

the center hardness (Ho) of the spherical core is 48 or more and less than 70 in Shore C hardness, the hardness ($H_{X-1}$) ranges from 63 to 82 in Shore C hardness, the hardness ($H_{X+1}$) ranges from 70 to 90 in Shore C hardness, the surface hardness ($H_{X+Y}$) of the spherical core is more than 70 and 90 or less in Shore C hardness, a hardness difference ($H_{X-1}$−Ho) between the center hardness Ho and the hardness $H_{X-1}$ ranges from 4 to 27 in Shore C hardness, the hardness difference ($H_{X+1}$−$H_{X-1}$) ranges from 0 to 18 in Shore C hardness, a hardness difference ($H_{X+Y}$−$H_{X+1}$) between the hardness $H_{X+1}$ and the surface hardness $H_{X+Y}$ ranges from −7 to 10 in Shore C hardness, a hardness difference ($H_{X+Y}$−Ho) between the center hardness Ho and the surface hardness $H_{X+Y}$ ranges from 14 to 35 in Shore C hardness, and the angle β ranges from −20° to +20°.

19. The golf ball according to claim 1, wherein the angle β ranges from −20° to 0°.

20. The golf ball according to claim 1, wherein the angle β is −20° or more and less than 0°.

* * * * *